US012012744B2

(12) United States Patent
Karius et al.

(10) Patent No.: US 12,012,744 B2
(45) Date of Patent: Jun. 18, 2024

(54) BEAM POCKET KIT AND ASSEMBLY

(71) Applicant: BEAM POCKET LLC, Denver, CO (US)

(72) Inventors: Paul Karius, Denver, CO (US); Peter Monroe, Denver, CO (US)

(73) Assignee: BEAM POCKET LLC, Denver, CO (US)

( * ) Notice: Subject to any disclaimer, the term of this patent is extended or adjusted under 35 U.S.C. 154(b) by 307 days.

(21) Appl. No.: 17/502,968

(22) Filed: Oct. 15, 2021

(65) Prior Publication Data

US 2022/0034078 A1 Feb. 3, 2022

Related U.S. Application Data

(63) Continuation-in-part of application No. 29/707,888, filed on Oct. 1, 2019, now Pat. No. Des. 940,538.

(51) Int. Cl.

| | |
|---|---|
| ***E04B 1/04*** | (2006.01) |
| ***E04B 1/24*** | (2006.01) |
| ***E04B 2/38*** | (2006.01) |

(52) U.S. Cl.

CPC ..... *E04B 1/043* (2013.01); *E04B 1/2403* (2013.01); *E04B 2/38* (2013.01); *E04B 2001/2424* (2013.01)

(58) Field of Classification Search

CPC .... E04B 1/043; E04B 2/38; E04B 2001/2424; E04B 1/2612; E04B 1/2403; E04G 21/26; E04G 17/14; E04G 17/04; E04G 17/16; E04G 17/18; E04G 15/06; E04G 15/061

See application file for complete search history.

(56) References Cited

U.S. PATENT DOCUMENTS

| | | | | | |
|---|---|---|---|---|---|
| 1,785,790 | A | * | 12/1930 | Ropp | E04B 1/2612 52/702 |
| 2,037,965 | A | * | 4/1936 | Colt | E04G 17/18 249/211 |
| 2,050,858 | A | * | 8/1936 | Pinaud | E04G 17/18 249/211 |
| 2,176,450 | A | * | 10/1939 | Barnett | E04B 1/2612 52/704 |
| 2,255,290 | A | | 9/1941 | Kennedy | |
| 2,625,815 | A | * | 1/1953 | Black | E04H 12/2261 52/707 |
| 2,871,692 | A | * | 2/1959 | Marter | E04G 15/061 52/302.1 |
| 2,881,876 | A | * | 4/1959 | Williams | E04H 1/1266 52/293.3 |

(Continued)

FOREIGN PATENT DOCUMENTS

| | | | | |
|---|---|---|---|---|
| KR | 950010827 | A | * | 5/1995 |
| KR | 20190109675 | A | * | 9/2019 |

*Primary Examiner* — Theodore V Adamos

(74) *Attorney, Agent, or Firm* — Dorsey & Whitney LLP

(57) ABSTRACT

An apparatus, such as a beam pocket, connects a beam to a wall, such as a concrete wall. The apparatus includes a frame having a plurality of panels that cooperate to define a pocket of various heights. The apparatus includes a clamp within the pocket. The clamp is configured to secure an end of the beam at a position within the pocket. The clamp is further configured to selectively define the position relative to the frame. The apparatus further includes at least one anchor extending from the clamp and away from the pocket for mounting with the wall.

20 Claims, 22 Drawing Sheets

(56) References Cited

U.S. PATENT DOCUMENTS 3,199,642 A * 8/1965 Anderson ..... B66B 7/024 187/408
3,321,880 A 5/1967 Ferrell et al.
3,645,057 A * 2/1972 Kaplan ..... E04H 12/2284 403/164
3,802,138 A * 4/1974 McCarter ..... E02D 5/80 52/149
3,890,758 A * 6/1975 Bouchard ..... E04B 1/4128 411/116
3,894,368 A * 7/1975 Crofoot ..... E04G 15/061 52/704
4,033,544 A * 7/1977 Johnston ..... E04G 17/14 249/40
D299,601 S 1/1989 Campbell
5,572,844 A 11/1996 Stackenwalt et al.
D403,534 S 1/1999 Gregory et al.
5,862,635 A * 1/1999 Linse ..... E04H 9/14 248/354.3
D404,946 S 2/1999 Geier et al.
D407,254 S 3/1999 Debooth
D557,796 S 12/2007 Esjunin et al.
D558,329 S 12/2007 Esjunin et al.
8,365,484 B2 * 2/2013 Foley ..... E04B 1/4114 403/403
8,424,982 B1 4/2013 Schwartz
D681,973 S 5/2013 Gibbs
D712,176 S 9/2014 Tamilarasan
8,827,235 B1 9/2014 Fisher, III
D750,908 S 3/2016 Hickman
D788,016 S 5/2017 Blincow
9,758,963 B2 9/2017 Kawai et al.
D856,532 S 8/2019 Bates
D912,496 S 3/2021 Fox
10,961,727 B2 3/2021 Rosales
D915,796 S 4/2021 Koplent-Zinyk
2003/0029112 A1 * 2/2003 Wise ..... E04G 9/083 52/439
2008/0042037 A1 2/2008 Orr
2008/0172976 A1 * 7/2008 Carney ..... E04B 5/12 52/702
2008/0282641 A1 11/2008 Sackett
2011/0107711 A1 * 5/2011 Foley ..... E04B 1/2403 52/655.1
2018/0002936 A1 * 1/2018 Murphy ..... B29C 39/00
2018/0258631 A1 9/2018 Pearson et al.
2020/0299960 A1 * 9/2020 Sharma ..... B29C 44/18

* cited by examiner

BEAM POCKET KIT AND ASSEMBLY

CROSS-REFERENCE TO RELATED APPLICATIONS

This application is a continuation-in-part of U.S. Design patent application Ser. No. 29/707,888 filed Oct. 1, 2019 entitled "BEAM POCKET", the entire disclosures of which is incorporated herein in its entirety by reference.

FIELD

The described examples relate generally to systems and methods for mounting a beam to a vertical structural member.

BACKGROUND

Vertical structural members, such as concrete walls, may include a beam pocket. The beam pocket may be an opening, cutout, passage or the like through the vertical structural member. The beam pocket may be configured to receive a structural member, such as a structural beam, and define an interface or engagement for structurally supporting the beam in an associated structure or building, at least in part, with the vertical wall. In conventional systems, a beams of wood or steel construction is supported in the void of the concrete, or by a steel plate embedded in the concrete or other materials in the vertical structural member.

In order to provide the void space in concrete to support the beam, structures must be built to prevent the concrete from filling the void. These structures are temporary and must be removed after the concrete or other solid structural material when fully set. These temporary structures in conventional systems are made of steel, wood, Styrofoam, cardboard or other material. After the concrete is solidified, and the temporary structure is removed, the process of setting the beam can begin. The conventional beam pockets of wood, cardboard, or Styrofoam often chipped away or removed using a labor-intensive process. The removal process may damage the newly formed concrete. Further, the resulting connection between the beam and the vertical structural member of conventional systems may be susceptible to various failure mechanisms, including rust or cracking, which may contribute to shear plane failures, and the like in the vertical structural members.

During beam installation, a crane hoists and supports the beam for a period of time for the connection to the vertical structural member. While the beam is supported by the crane, various different shims are added and subtracted in a beam pocket between the vertical wall and the beam in order to set an appropriate height and level of the beam in the structure. This procedure of placing shims below a partially secured beam, secured by crane, may result in finger and hand injuries, since the shims are hand placed below the bottom flange of the steel beam. When compared to steel embed plate the steel beam must be welded to the plate or a tab plate of steel to support the beam. Field welding a steel plate or steel tab on a ladder or elevated platform for the tab or steel embed plate can result in fall injuries or crushing injuries while the beam is supported by the crane.

Upon disengagement by the crane, the height and level of the beam can no longer be adjusted in conventional systems. In some cases, conventional beam pockets are then filled at least partially with concrete, grout, or other materials in order to further secure the beam to the vertical structural member. Some beam connections utilize anchor bolts cast into the concrete but require hole in the steel beams for exact alignment. Further, the resulting connection between the beam and the vertical structural member of conventional systems may be susceptible to various failure mechanisms, including rust or cracking, which may contribute to shear plane failures, and the like in the vertical structural members. As such, there is a need for systems and techniques that secure beams to vertical structural members.

SUMMARY

Examples of the present invention are directed to an apparatus, such as a beam pocket, for connecting a beam to a wall. The apparatus includes a frame having a plurality of panels that cooperate to define a pocket void. The apparatus may further include a clamp and anchor bolts within the pocket and configured to secure an end of the beam at a position within the pocket. The clamp may be configured to selectively define the position relative to the frame and the cast wall. The apparatus includes at least one anchor extending from the clamp and away from the pocket for mounting with the wall. The anchor and clamp system supports streamlined beam placement without holes and/or alignments for the placement of the steel beam.

In another example, the apparatus includes a structural angle integrated with the frame between a first panel and a second panel of the plurality of panels. The structural angle, the first panel, and second panel may cooperate to define different sides of the pocket. The structural angle may include a steel angle having a first portion define a side of the pocket and a second portion configured for flush mounting with the wall. The first and second portions may be arranged perpendicular to one another. The at least one anchor may extend from the clamp and through the first portion of the structural angle and include an end arranged outside of the pocket for mounting with the wall. Further, the at least one anchor may include a first anchor and a second anchor, each of the first and second anchors extending from the clamp and through the first portion of the structural angle for mounting of ends of the respective first and second anchors in the wall. The angle may assist in distributing the point load from the beam into concrete or vertical wall, thereby reducing the possibility of shear plane failure of the wall below the beam pocket.

In another example, the clamp may include a bearing plate configured to seat the end of the beam. The bearing plate may be configured to receive a grouting thereunder. Further, the clamp may include at least one clamping component configured to engage the end for the beam opposite the bearing plate. In some cases, the at least one clamping component and the bearing plate may be engaged with the at least one anchor in the pocket. A position of the clamping plate and the bearing plate may be adjustable along the at least one anchor to clamp and secure the end of the beam in the apparatus.

In another example, the at least one anchor may include a threaded end advanced through each of the at least one clamping component and the bearing plate. The apparatus may further include a bottom nut threadingly engaged with the threaded end and manipulatable to define a stop position for the bearing plate in the pocket. The apparatus may further include a top nut threadingly engaged with the threaded end and manipulatable to compress the at least one clamping component toward the bearing plate.

In another example, the at least one clamping component includes a first clamping component and a second clamping component. The first and second clamping components may be arranged relative to the bearing plate to receive a web of a beam therebetween. The at least one anchor may include a first anchor engaged with the bearing plate and the first clamping component. The at least one anchor may include a second anchor engaged with the bearing plate and the second clamping component. The first and second clamping components may be adjustable relative to the respective first and second anchors in order to compress a flange of the beam between the first and second clamping components and bearing plate. The attachment method of the clamp allows minor lateral movement due to expansion and contraction of the steel beam.

In another example, the plurality of panels may include a first panel and a second panel. The first and second panels may form vertical sides and back of the pocket. The apparatus may further include at least one reinforcement shelf spanning a vertical width of the pocket defined by the first and second panels. The at least one reinforcement shelf may be configured to maintain the vertical width during an installation of the apparatus.

In another example, an apparatus for connecting a beam to a wall is disclosed. The apparatus includes a plurality of panels. The apparatus further includes a structural angle positioned between a first panel and a second panel of the plurality of panels. The apparatus further includes a first anchor positioned through the structural angle and extending away from plurality of panels. The apparatus further includes a second anchor positioned through the structural angle and extending away from the plurality of panel. The apparatus further includes a bearing plate engaged with the first and second anchor and positioned between the first panel and the second panel. The apparatus further includes a first clamping component engaged with the first anchor above the bearing plate. The apparatus further includes a second clamping component engaged with the second anchor above the bearing plate.

In another example, a method of connecting a beam to a wall is disclosed. The method includes setting an apparatus in a concrete wall, the apparatus including a pocket therein. The method further includes setting an end of a beam on a bearing plate of the apparatus. The method further includes clamping a flange of beam to the bearing plate using first and second clamping components arranged on opposing sides of a web of the beam.

In another example, setting the apparatus in a concrete wall includes attaching a frame of the apparatus to formwork, pouring concrete, and removing the formwork with the apparatus permanently affixed to the concrete. The method may further include setting a height of the bearing plate in the pocket.

In another example, the bearing plate may be engaged with a first anchor at a first bearing plate end and a second anchor at a second bearing plate end. In this regard, the height of the bearing plate may be defined by a first nut threadingly engaged with the first anchor under the bearing plate and a second nut threadingly engaged with the second anchor under the bearing plate. The method may further include grouting a region below the bearing plate.

In addition to the exemplary aspects and examples described above, further aspects and examples will become apparent by reference to the drawings and by study of the following description.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Figure 1:
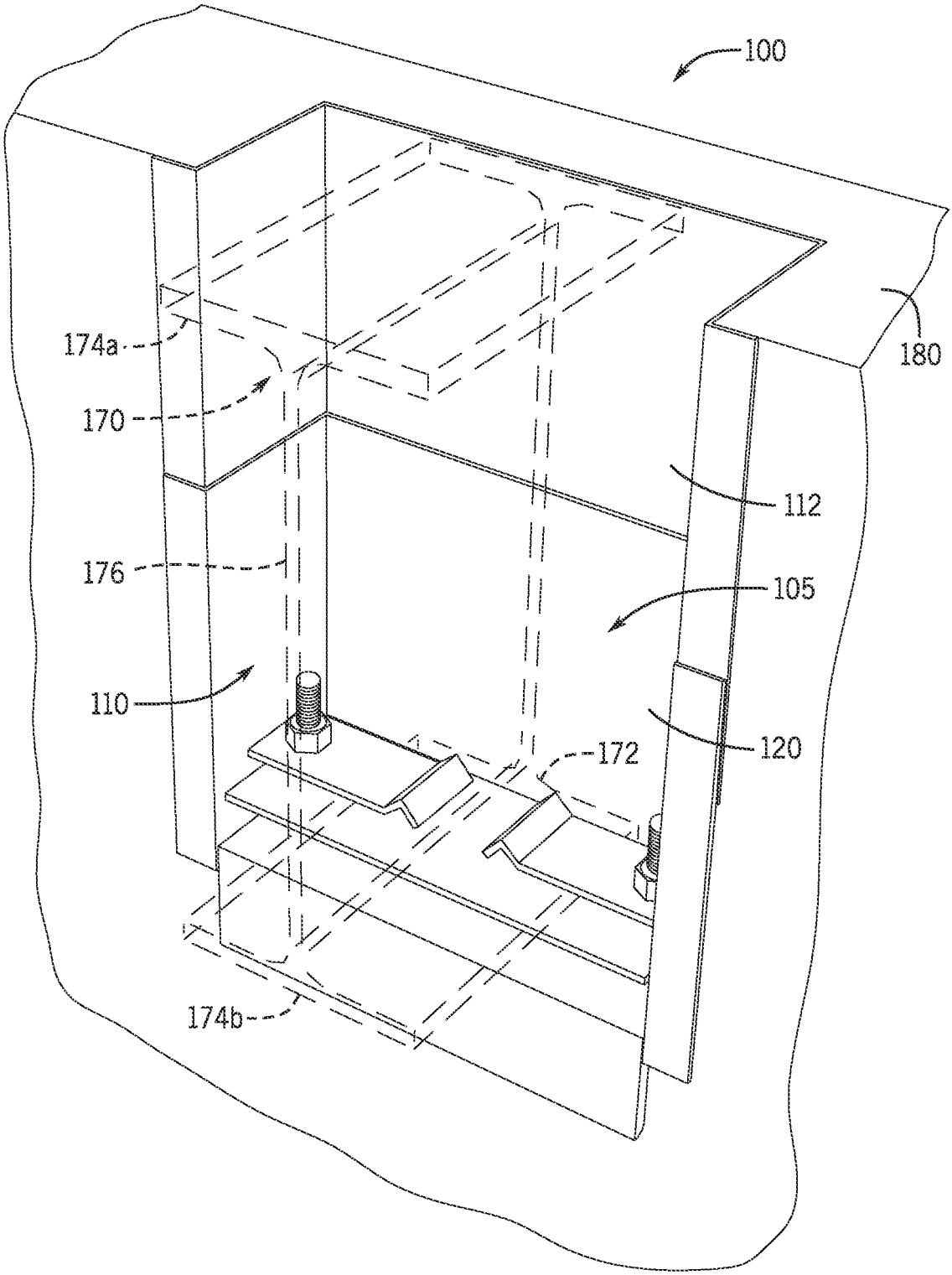
FIG. 1 depicts a systems including an apparatus connecting a beam to a wall, the wall formed from concrete.

The description that follows includes sample systems, methods, and apparatuses that embody various elements of the present disclosure. However, it should be understood that the described disclosure may be practiced in a variety of forms in addition to those described herein.

The following disclosure relates generally to an apparatus for connecting a structural beam to a vertical structural member, and associated methods of assembly and attachment thereto. The vertical structural member may include substantially any member used to form a wall, fully or in part, such as a load-bearing wall of a structure. Sample vertical structural members include, without limitation, a standard concrete wall (of various consistencies, shapes, ratings, and so on), an insulated concrete form (ICF) concrete wall, and the like. It will be appreciated that while the apparatus of the present disclosure is described herein with reference to one or more vertical structural members, this is for purposes of illustration and the apparatus may be implemented with a variety of different types and constructions of the vertical structural member without departing from the scope of the disclosure herein. A structural beam, as used herein, may include substantially any structural member supported by the vertical structural member to form a structure. A structural beam, without limitation, may include various I-beams, H-beams, "w" or wide-flange beams, and so on. A structural beam may further include a wood beam or various sizes and types. The structural beam may be arranged generally horizontal relative to the vertical structural member and structurally supported thereon to carry both shear and bending loads.

A vertical structural member may have a beam pocket, such as an opening, cutout, void or the like configured to receive the structural beam. The apparatus of the present disclosure may provide an interface or connection between the vertical structural member and the structural beam. The apparatus may be permanently affixed to the vertical structural member. As such, the apparatus does not require removal pre-crane time that could otherwise damage the vertical structural member. The permanently affixed apparatus may also thus define a physical barrier between the vertical structural member and the structural beam that may mitigate or prevent various failure mechanisms, such as rust or cracking, as described herein. Further, the apparatus may be generally configured to adjust or selectively define a position of an end of the beam in the beam pocket. The apparatus may be configured to selectively define the position of the end of the beam without the beam being continuously supported by a crane, which reduces overall crane time and job cost, among other benefits.

In one example, the apparatus may include a frame having a plurality of panels. The plurality of panels may be formed from various materials, such as sheet metal, and cooperate to define a pocket. The plurality of panels allows for adjustment of height of the apparatus to accommodate various heights of beams. The apparatus may further include a clamp with the pocket configured to secure an end of the beam therein. As described in greater detail below, the clamp may include a bearing plate upon which a bottom side of a flange of the structural beam rests, and one or more clamping portions that engage an opposing side of the flange. The bearing plate and the clamping portions may be moved or compressed toward one another in order to clamp and secure the beam in place. Further, the bearing plate and the clamping portions may be height-adjustable within the pocket in order to selectively define the height of the end of the beam in the beam pocket. The apparatus may further include at least one anchor extending from the clamp and away from the pocket for mounting and anchoring within the vertical structural member, such as a concrete wall. In some cases, one end of the at least one anchor may be fixedly set in the wall, and an opposing end may be threaded for engagement with the bearing plate and at least one of the clamping portions. In this manner, the bearing plate and clamping portions may be adjustable in the pocket while the apparatus is fixedly set in the vertical structural member via the at least one anchor.

The structure of the apparatus may allow for the permanent installation of the apparatus with a vertical structural wall before setting a beam. In the example of a concrete wall, the apparatus may be initially temporarily installed to formworks for the concrete wall. The formworks may be filled with wet concrete or other building materials in order to form the wall. In so doing, the apparatus may become permanently affixed to the concrete wall, for example, using the at least one anchor extending from the frame and panels. The apparatus may be set in the concrete such that when the formworks are removed, the pocket defined by the panels is exposed along an outer surface of the wall. An end of a structural beam may then be maneuvered into the exposed pocket and rested on the bearing plate, for example, using a crane. The crane may cease operations, and the end of the beam may be lowered or raised in the pocket by adjusting a height of the bearing plate therein. The end of the beam may then be clamped in place by the clamping portions engaging and compressing an opposing side of the beam flange. Grouting or other materials may then be added to below the bearing plate. The grouting may be added in a manner to reduce moisture and rust degradation of the beam.

Turning to the drawings, for purposes of illustration FIG. 1 depicts a system 100 including an apparatus 110 and vertical structural member 180, such as a concrete or ICF-type wall. As shown in FIG. 1, the apparatus 110 is set in and permanently affixed to the vertical structural member 180. The apparatus 110 may define a connection or interface between the vertical structural member 180 and a structural beam 170 (shown in phantom line). The illustrative structural beam 170 is illustrated in FIG. 1 as including an end 172, a top flange 174*a*, a bottom flange 174*b*, and a web 176. The apparatus 110 may be configured to receive and secure the end 172 of the structural beam 170. For example, the apparatus 110 may define a pocket 105, which may be a void or space of, or otherwise within a profile or footprint defined by, the vertical structural member 180. The apparatus 110 may be configured to receive the end 172 and secure the end 172 within the pocket 105, according to structures and techniques described herein.

Figure 2:
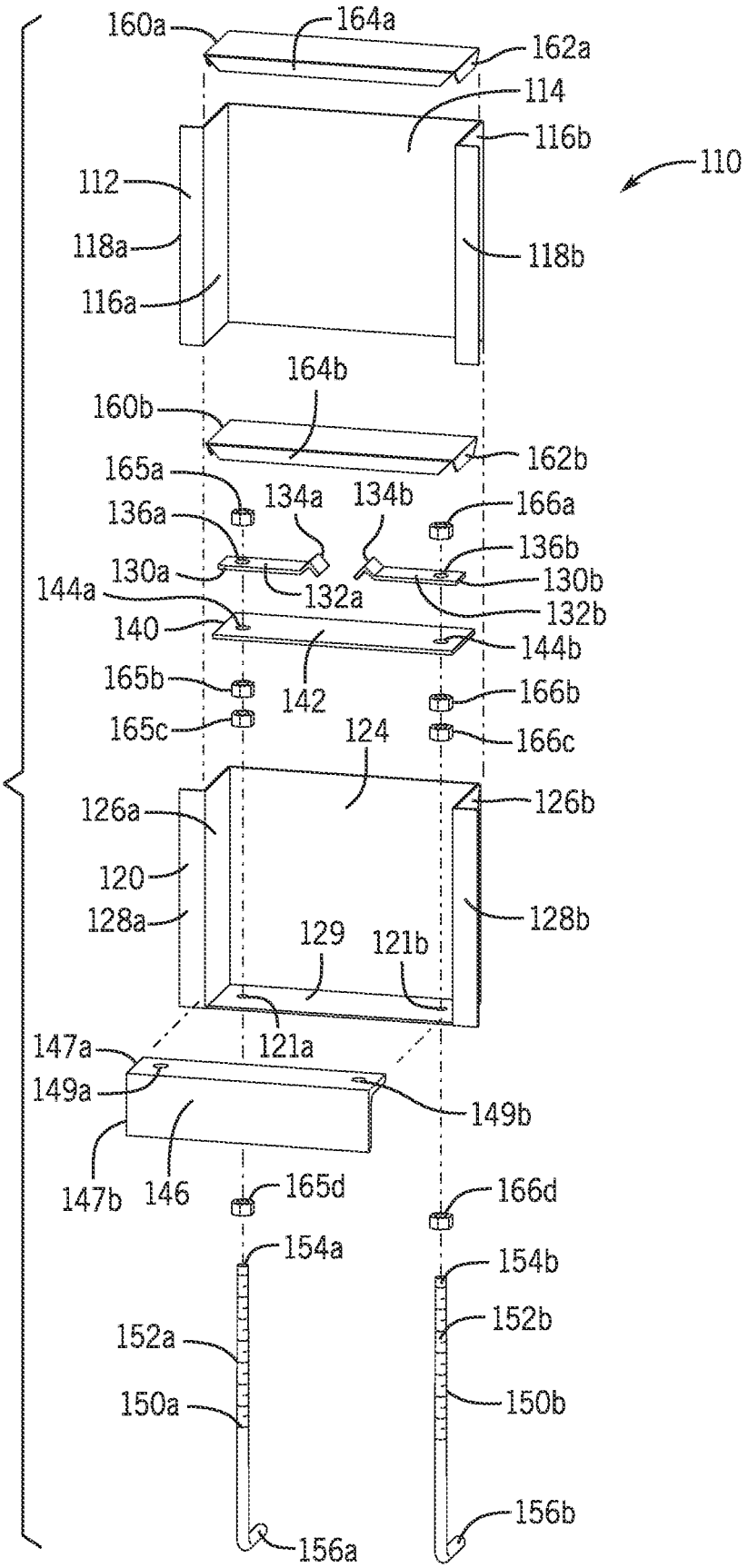
FIG. 2 depicts an exploded view of the apparatus of FIG. 1.

FIG. 2 illustrates an exploded view of the apparatus 110, including various component and subassemblies that cooperate to secure the end 172 of the structural beam 170 to the vertical structural member 180. For example, the apparatus 110 may include a first frame portion 112 and a second frame portion 120. The first and second frame portions 112, 120 may collectively define a frame of the apparatus 110. The first and second frame portions 112, 120 may cooperate to define the pocket 105. The first and second frame portions 112, 120 may be formed from various materials, such as various sheet metal materials. Each of the first and second frame portions 112, 120 may include a plurality of panels or side or sections. The plurality of panels of the respective first or second frame portions 112, 120 may define portions of the shape or the pocket 105, such as a being arranged in a generally U-shape or another appropriate configuration that defines one, two or three sides of the pocket 105.

With reference to the first frame portion 112, the plurality of panels may include a back panel 114, first frame portion side panels 116*a*, 116*b*, and first frame portion lips 118*a*, 118*b*. The back panel 114 may be sized to accommodate a width of the structural beam 170, such as being at least as wide or wider than a width of the structural beam 170. The first frame portion side panels 116*a*, 116*b* may be arranged extending generally perpendicularly from opposing edges of the back panel 114. The first frame portion lips 118*a*, 118*b* may be arranged extending generally perpendicularly from respective ones of the first frame portion side panels 116*a*, 116*b*. Corresponding pairs of the first frame portion side panels 116*a*, 116*b* and first frame portion lips 118*b* may establish a corner configured to receive an edge of the vertical structural member 180.

With reference to the second frame portion 120, the plurality of panels may include a back panel 124, second frame portion side panels 126*a*, 126*b*, and second from portion lips 128*a*, 128*b*. The plurality of panels of the second frame portion 120 may be substantially analogous to those described above in relation to the first frame portion 112; redundant explanation of which is omitted herein for clarity. Notwithstanding the foregoing similarities, the second frame portion 120 may further include a bottom panel 129. The bottom panel 129 may be connected to bottommost edges of the back panel 124, and the second frame portion side panels 126*a*, 126*b*. The bottom panel 129 is shown in FIG. 2 as including through portions 121*a*, 121*b*. The through portions 121*a*, 121*b* may be generally circular openings configured to receive one or more structural members, such as anchors, as described herein.

The apparatus 110 may further include a clamp configured to secure the end 172 of the structural beam 170 and selectively define the position of the end 172 in the pocket. As shown in FIG. 2, the apparatus includes a bearing plate 140, a first clamp portion 130*a*, and a second clamp portion 130*b*. The bearing plate 140, and the first and second clamp portions 130*a*, 130*b* may collectively define the clamp, as described herein. The bearing plate 140 may be a plate of material configured to engage a flange of a structural beam, such as the flange 174*b* shown in FIG. 1. The bearing plate 140 may include a plate body 142 that spans the width of the pocket 105, as defined by the frame. The plate body 142 may be generally of thicker construction than the panels of the frame. The plate body 142 may include through portions 144*a*, 144*b* formed through the plate body 142 at opposing ends of the plate body 142. The through portions 144*a*, 144*b* may be generally circular openings configured to receive one or more structural members, such as anchors, as described herein.

The first clamp portion 130*a* may include a clamp portion body 132*a*, an engagement end 134*a*, and a through portion 136*a*. The clamp portion body 132*a* may be formed from a sheet of metal material, such a sheet of metal material of construction substantially analogous to that of the bearing plate 140. The first end of the clamp portion body 132*a* may include the through portion 136*a* extending therethrough. The through portion 136*a* may be a generally circular opening configured to receive one or more structural members, such as anchors, as described herein. A second, opposing end of the clamp portion body 132*a* may include or otherwise define the engagement end 134*a*. In one example, the engagement end 134*a* may include a section of bent or angled, such as at a substantially perpendicular angle, portion of the first clamp portion body 132*a*, as shown in FIG. 2. More generally, the engagement end 134*a* may include any appropriate structure to facilitate engagement or clamping of the clamp with a flange of a structural beam. It will therefore be appreciated that other arrangements and orientations of the engagement end 134*a* are contemplated herein, including engagement ends defined by a portion of the clamp portion body 132*a* bent at greater and or less ninety degrees. The second clamp portion 130*b* may be substantially analogous to the first clamp portion 130*a* and include a clamp portion body 132*b*, an engagement end 134*b*, and a through portion 136*b*; redundant explanation of which is omitted herein for clarity.

The apparatus 110 may further include a structural angle 146, as depicted in FIG. 2. The structural angle 146 may be a steel angle configured to facilitate weight distribution of the structural beam 170 relative to the vertical wall 180. The structural angle 146 may be thicker and more robust than either than the panels of the frame or the bearing plate 140 and clamping portions 130*a*, 130*b*. In one example, the structural angle 146 may be a 4×4×½ steel angle; however, in other cases, other dimensions and constructions are possible and contemplated herein. In the example of FIG. 2, the structural angle 146 is shown having a first portion 147*a* and a second portion 147*b*. The first and second portions 147*a*, 147*b* may generally have a width corresponding to a width of the pocket 105, as defined by the frame. The first and second portions 147*a*, 147*b* may be connected to one another, integrally, are arranged generally perpendicular to one another. The first portion 147*a* may include through portions 149*a*, 149*b* form therethrough. The through portions 149*a*, 149*b* may be generally circular openings configured to receive one or more structural members, such as anchors, as described herein.

Figure 5:
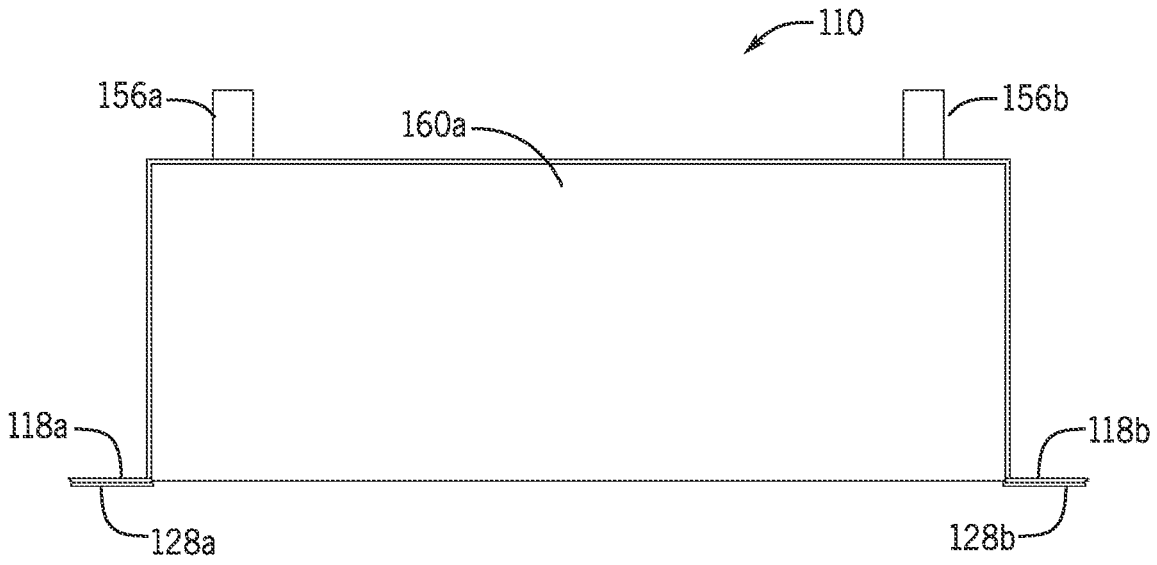
FIG. 5 depicts a top plan view of the apparatus of FIG. 1.
Figure 6:
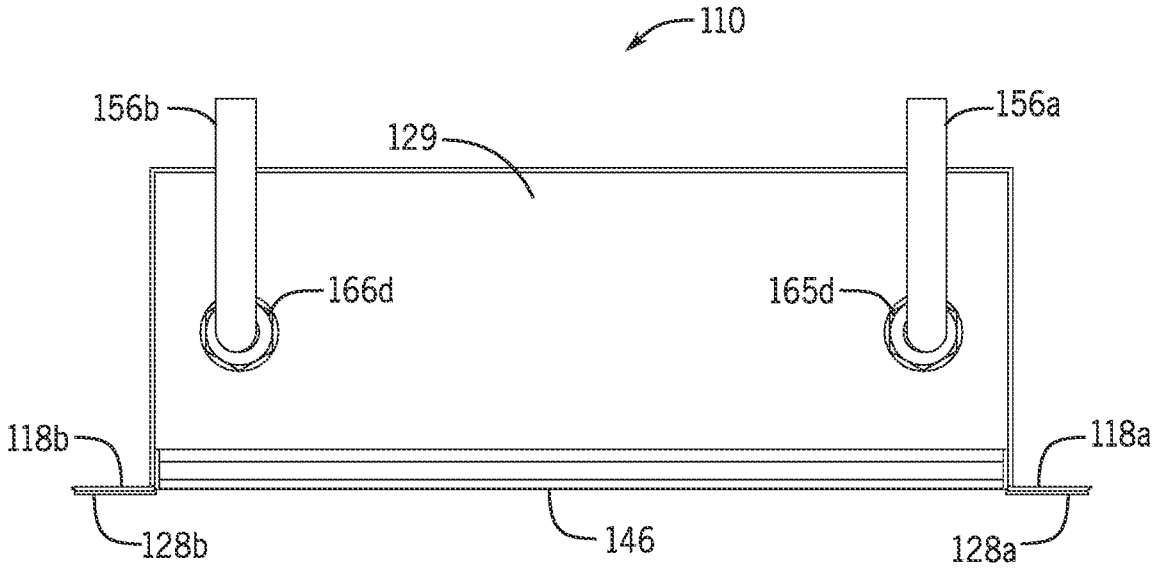
FIG. 6 depicts a bottom plan view of the apparatus of FIG. 1.

The apparatus 110 may further include one or more anchor components that are used to permanently affix the apparatus 110 to the vertical structural member 180. With reference to FIG. 2, a first anchor component 150*a* and a second anchor component 150*b* is shown. The first and second anchor components 150*a*, 150*b* may be anchor bolts or other elongated members that are configured to extend into a wall a sufficient distance to support anchoring of the apparatus 110 into the wall. The first anchor component 150*a* is shown in FIG. 2 as including a threaded portion 152*a*, a pocket end 154*a*, and a wall end 156. The threaded portion 152*a*, the pocket end 154*a*, and the wall end 156*a* may be portions or sections of a single bolt, for example. The threaded portion 152*a* may include helical or other threads for threadably engaging one or nuts thereon. The threaded portion 152*a* may be elongated and extend to or adjacent to the pocket end 154*a*. The pocket end 154*a* may a terminal end of the first anchor component 150*a* that, in an installed configuration, is positioned within the pocket 105. In this regard, and as described herein below, the pocket end 154*a* may receive one or more through portions of the clamp, frame or other components, which in turn may be secured thereon via the threaded engagement of a but with the threaded portion 152*a*. The wall end 156*a* may be an opposing end of the first anchor component 150*a*, opposite the pocket end 154*a*. The wall end 156*a* may be angled or curved relative to an elongated portion of the first anchor component 150*a*. The angle or curve may allow the first anchor component 150*a* to extend in at least two directions with the vertical structural member 180 in order to facilitate anchoring therein, as illustrated herein at FIGS. 5 and 6. The second anchor component 150*b* may be substantially analogous to the first anchor component 150*a* and include a threaded portion 152*b*, a pocket end 154*b*, and a wall end 156*b*; redundant explanation of which is omitted herein for clarity.

As described herein, the various components of the clamp are engageable with the one or more anchor components in order to define a position of the structural beam 170 in the pocket 105. The various components of the clamp are further engageable with the one or more anchor components in order to selectively adjust the position of the structural beam 170, as needed. In this regard, the exploded view includes a collection of nuts that are threadably engageable with the respective first and second anchor components 150*a*, 150*b*. With reference to FIG. 2, the apparatus includes a plurality of first anchor component nuts, such as a first anchor clamp portion nut 165*a*, a first anchor bearing plate nut 165*b*, a first anchor structural angle nut 165*c*, and a first anchor frame nut 165*d*. With further reference to FIG. 2, the apparatus includes a plurality of second anchor component nuts, such as a second anchor clamp portion nut 165*b*, a second anchor bearing plate nut 165*b*, a second anchor structural angle nut 165*c*, and a second anchor frame nut 165*d*.

With further reference to FIG. 2, reinforcement shelves 160*a*, 160*b* are shown. Generally, reinforcement shelfs may be used as temporary members of the apparatus 110 that are configured to maintain a width of the apparatus 110 during installation, such as during concrete pouring or setting. For example, the reinforcement shelves 160*a*, 160*b* may be connect to and fit in the frame, such as extending a span between the side panels 116*a*, 116*b* and/or side panels 126*a*, 126*b* such that the frame may maintain the shape of the pocket 105 during the installation. The reinforcement shelf 160*a* is shown in FIG. 2 as including a bracing tabs 162*a* and formwork tab 164. The bracing tabs 162*a* may be folds of the reinforcement shelf 160*a* that are configured for engagement with, for example, the side panels 118*a*, 118*b*. In some cases, screws may be used to secure the bracing tabs 162 to respective ones of the side panels 116*a*, 116*b*. The formwork tab 164 may run generally perpendicular to the bracing tabs 162 and be configured to engagement with the formwork during installation. The formwork tab 164 may also enhance a rigidity of the reinforcement shelf 160*a* along a dimension of the width of the pocket 105. The second reinforcement shelf 160*b* may be substantially analogous to the first reinforcement shelf 160*a* and including bracing tabs 162*b* and a formwork tab 164*b*; redundant explanation of which is omitted here for clarity.

Figure 3:
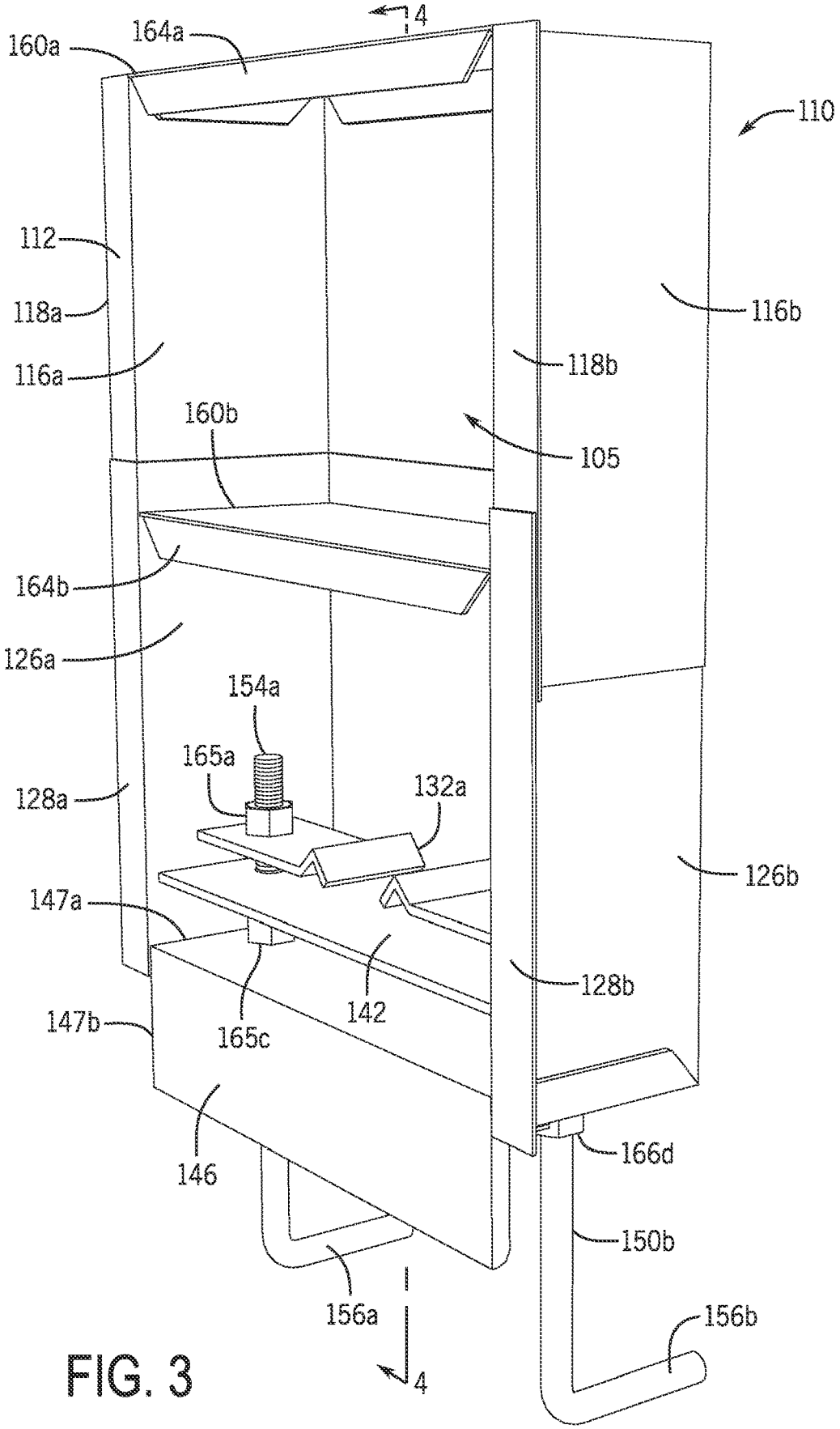
FIG. 3 depicts a front perspective view of the apparatus of FIG. 1.

The apparatus 110 may be coupled or assembled such that that apparatus 110 is configured to receive and secure the end 172 of the structural beam 170. For example, the first frame portion 112 and the second frame portion 120 may be coupled with one another to collectively define the frame having the pocket 105. As shown in the example of FIG. 3, the first frame portion 112 may receive the second frame portion 120 (or vice versa) to define the pocket 105. For example, the second frame portion 120 may be slid into a volume defined by the first frame portion 112 such that at least a region of the first and second frame portions 112, 120 overlap one another. A size of the pocket 105 may be defined by the size of the overlap between the first and second frame portions 112, 120. This may allow the first and second frame portions 112, 120 to be manipulated relative to one another to vary the size of the pocket 105 based on the size of the structural beam 170. This may permit the apparatus 110 to accommodate beams of various sizes and types. Where the structural beam 170 is smaller, for the sake of illustration, the overlap between the first and second frame portions 112, 120 may be larger in order to define a smaller size of the pocket 105. Conversely, where the structural beam 170 is larger, the overlap between the first and second frame portions 112, 120 may be smaller in order to define a larger size of the pocket 105. The first and second frame portions 112, 120 may be secured to one another along or in the overlap using screws, adhesive, or more generally fasteners of various types.

Figure 4:
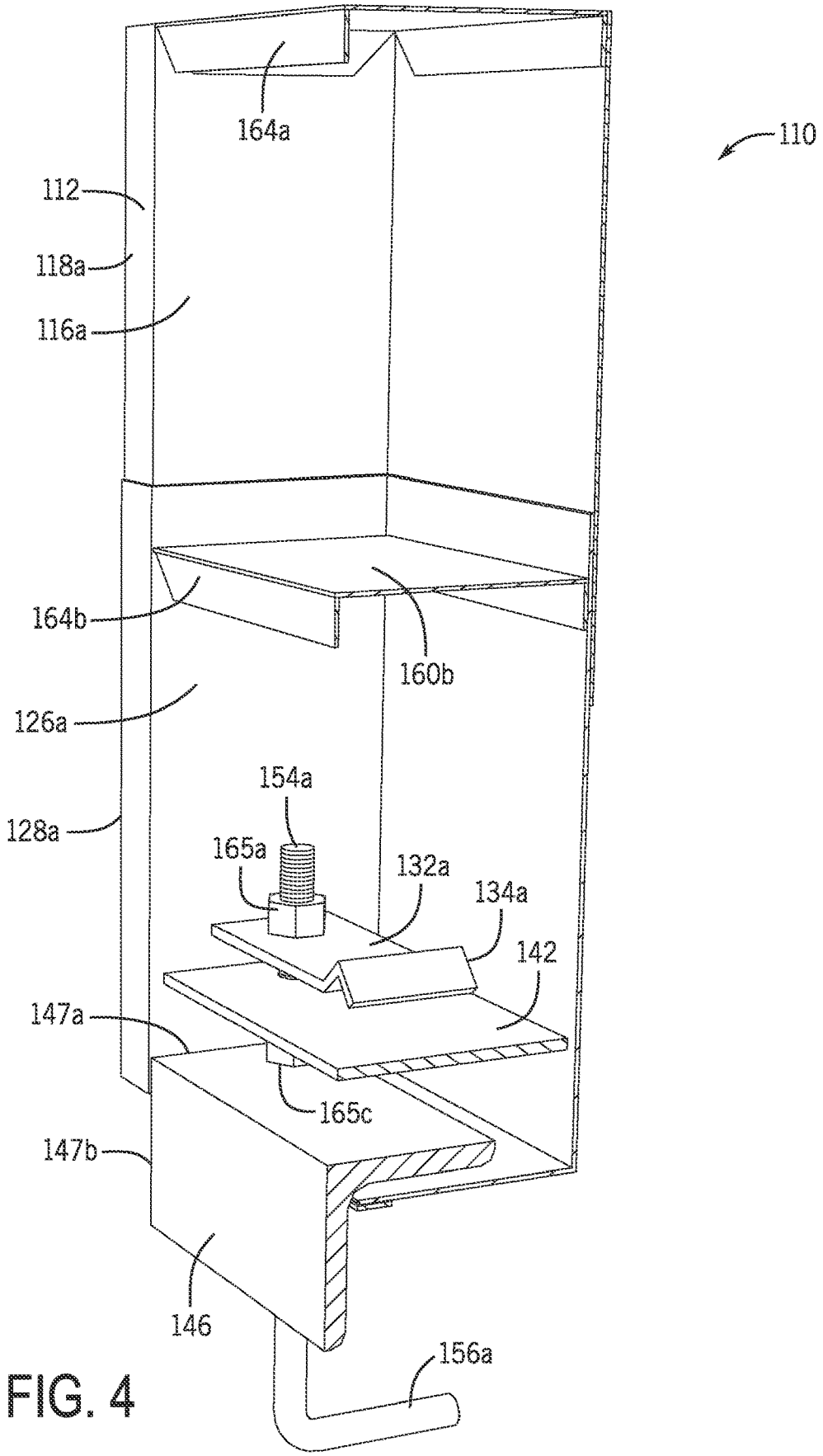
FIG. 4 depicts a cross-sectional view of the apparatus of FIG. 1, taken along line 4-4 of FIG. 3.

The apparatus 110 may further be coupled or assembled using the reinforcement shelves 160*a*, 160*b* to maintain the size of the pocket 105 during construction of the vertical structural member 180 due to hydrostatic pressure. As shown with reference to FIGS. 3 and 4, the reinforcement shelves 160*a*, 160*b* may be set in the pocket 105 and extend across an entire width of the pocket 105. Respective ones of the reinforcement shelves 160*a*, 160*b* may be attached to the first or the second frame portions 112, 120. The reinforcement shelves 160*a*, 160*b* may be attached in a manner that enhances a rigidity of the first or second frame portions 112, 120 such that the first and second frame portions 112, 120 resist external forces from a concrete pour, and the like, and generally maintain the width of the pocket 105 during construction and assembly. To illustrate, with reference to the reinforcement shelf 160*a*, the bracing tabs 162*a* may be connected to respective ones of the side panels 116*a*, 116*b*. Fasteners of various types may be used, such as set screws. High-strength adhesives are also contemplated. Accordingly, the reinforcement shelf 160*a* may be fixedly attached to the first frame portion 112 and span an entire width of the first frame portion 112 between the side panels 116*a*, 116*b*. The reinforcement shelf 160*a* may therefore enhance a rigidity of the first frame portion 112 between the panels 116*a*, 116*b*. In this regard, and as described herein with reference to FIGS. 17-20, the first frame portion 112 may operate to resist external forces, such as that from a concrete pour, in part, due to the enhanced rigidity provided by the reinforcement shelf 160*a*. The second reinforcement shelf 160*b* may be coupled to the second frame portion 120 in a substantially analogous manner; redundant explanation is omitted here for clarity.

In preparation for assembly with the vertical structural member 180, the apparatus may be further coupled with components of the clamp and the components of the at least one anchor component. For purposes of illustration, and with reference to FIGS. 2 and 7, initially, the structural angle 146 may be set in the pocket 105. For example, the structural angle 146 may be set in the pocket 105 and rested on the bottom panel 129. The structural angle 146 may be arranged in the pocket 105 with the first portion 147*a* defining a side, such as a bottom side, of the pocket 105. The structural angle 146 may be arranged with the through portions 147*a*, 147*b* generally aligned with the through portions 121*a*, 121*b* of the first portion 147*a*. The second portion 147*b* of the structural angle 147*b* may extend outside of the pocket 105 for generally flush mounting and arrangement with the vertical structural member 180. In some cases, the second portion 147*b* of the structural angle 146 may be generally arranged flush or otherwise aligned with the lips 118*a*, 118*b* of the first frame portion 112, and/or the lips 128*a*, 128*b* of the second frame portion 120.

Figure 7:
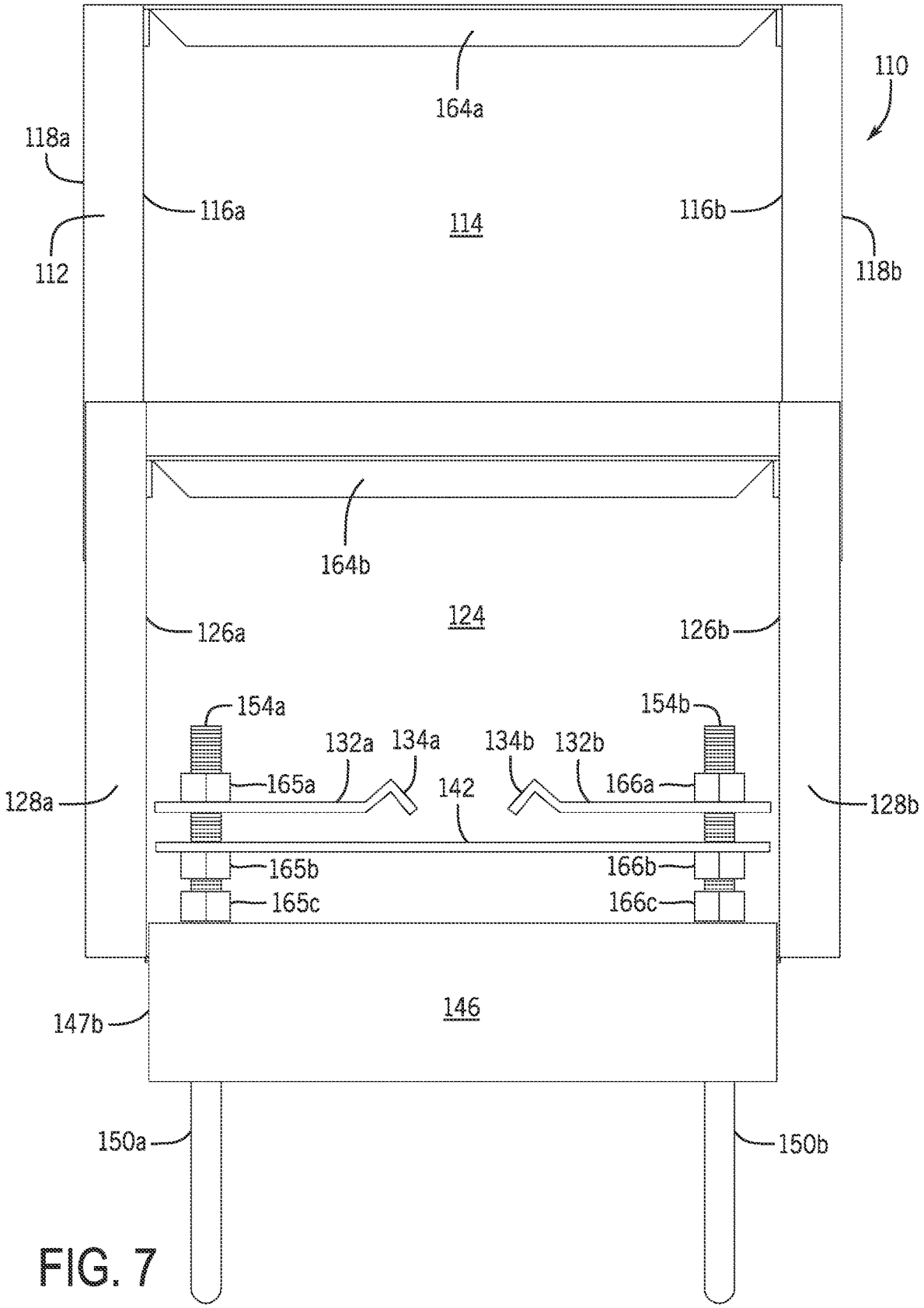
FIG. 7 depicts a front view of the apparatus of FIG. 1.
Figure 8:
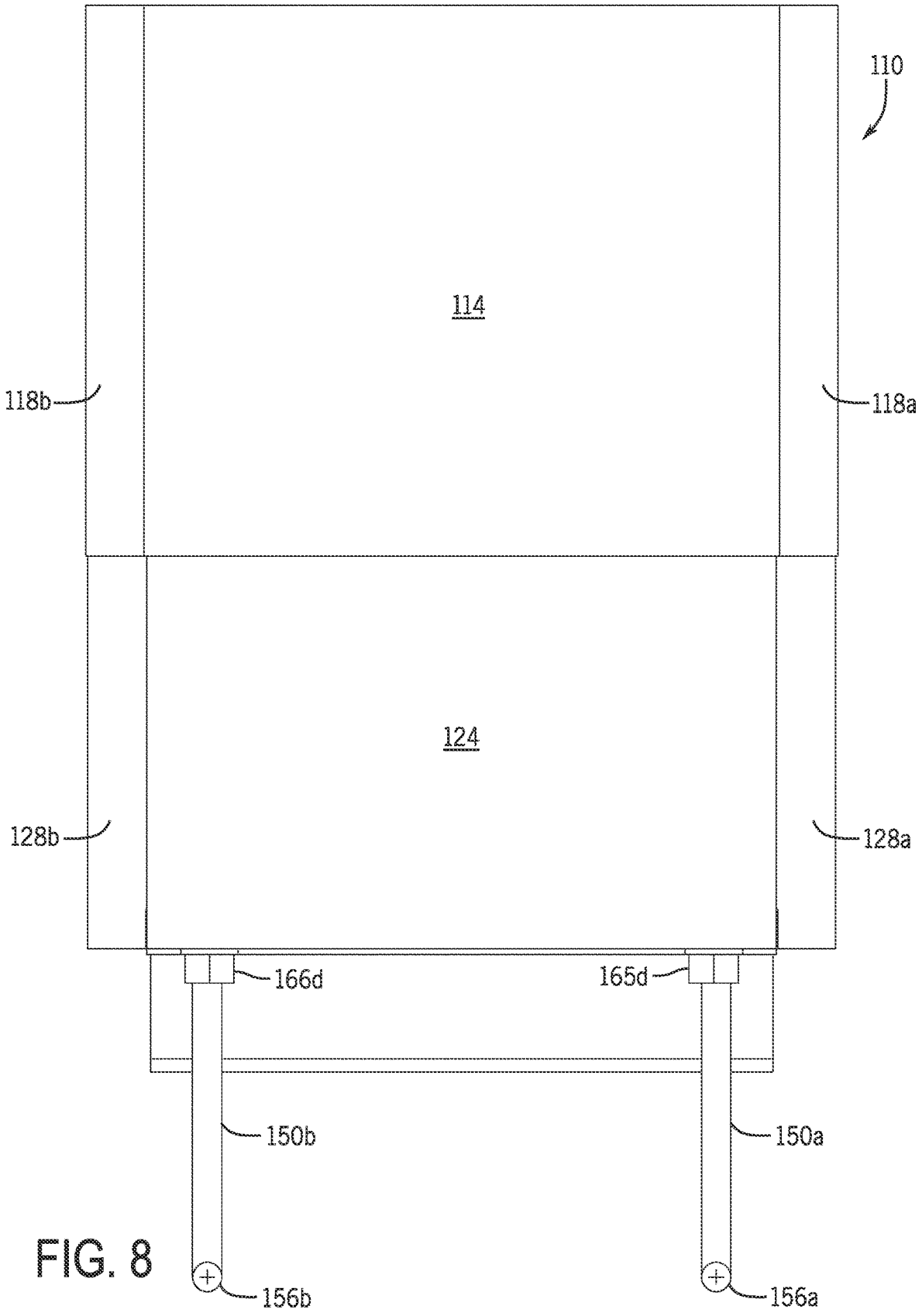
FIG. 8 depicts a rear view of the apparatus of FIG. 1.
Figure 9:
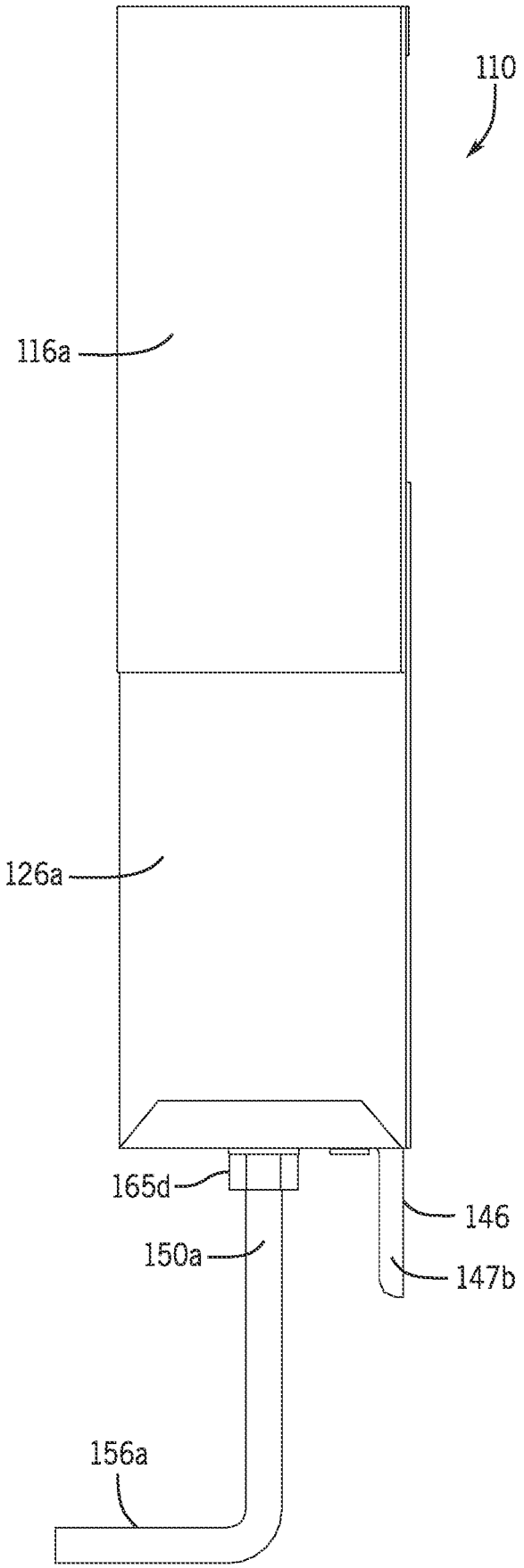
FIG. 9 depicts a left view of the apparatus of FIG. 1.

The apparatus 110 may be further coupled with the first anchor component 150*a*. The first anchor frame nut 165*d* may be threaded onto the threaded portion 152*a*. The first anchor component 150*a* may then be advanced through the through portion 121*a* of the bottom panel 129 and the through portion 147*a* of the structural angle 146. For example, the first anchor component 150*a* may be advanced through the through portions 121*a*, 147*a* such that the pocket end 154*a* is positioned in the pocket 105 with the threaded portion 152*a* being partially arranged in the pocket 105 as well. The first anchor frame nut 165*d* may be outside of the pocket 105 and limit the advancement of the first anchor component 150*a* into the pocket 105, as shown in FIGS. 7 and 8. In this regard, the first anchor frame nut 165*d* may be adjusted along the threaded portion 152*a* in order to set a height of the pocket end 154*a* in the pocket 105. Further, the first anchor component 150 may be arranged such that the wall end 156*a* is arranged extending away from the frame, as illustrated in FIG. 9. The second anchor component 150*b* may be similarly coupled with the apparatus 110. For example, the second anchor frame nut 166*d* may be threaded onto the threaded portion 152*b* of the second anchor component 150*b*. The second anchor component 150*b* may then be advanced through the through portion 121*b* of the bottom panel 129 and the through portion 147*b* of the structural angle 146 in a manner substantially analogous to the first anchor component 150*a*.

Next, components of the clamp may be arranged in the pocket 105 and engaged with the first and second anchor components 150*a*, 150*b*. To support the engagement of the clamp, initially, the first anchor bearing plate nut 165*b* and the first anchor structural angle nut 165*c* may be threaded onto the threaded portion 152*a* of the first anchor component 150*a*. Similarly the second anchor bearing plate nut 166*b* and the second anchor structural angle nut 166*c* may be threaded onto the threaded portion 152*b* of the second anchor component 150*b*. The first anchor structural angle nut 165*c* and the second anchor structural angle nut 166*c* may be threaded onto the respective threaded portions 152*a*, 152*b* in order to secure the structural angle 146 to the bottom panel 129 of the second frame portion 120. For example, the first anchor structural angle nut 165*c* and the second anchor structural angle nut 166*c* may be threaded onto the respective threaded portions 152*a*, 152*b* such that the structural angle 146 is maintained in a position with the first portion 147*a* defining a side of the pocket 105 and a second portion 147*b* being outside the pocket 105 and generally perpendicular to a bottom side of the pocket 105.

The first anchor bearing plate nut 165*b* and the second anchor bearing plate nut 166*b* may be threaded onto to the respective threaded portions 152*a*, 152*b* in order to define a seat for the bearing plate 140. For example, the bearing plate 140 may be engaged with the first and second anchor components 150*a*, 150*b* with the through portion 144*a* advanced to receive the pocket end 154*a* and through portion 144*b* advanced to receive the pocket end 154*b*. The bearing plate 140, upon receipt, may rest on the first anchor bearing plate nut 165*b* and the second anchor bearing plate nut 166*b*. The first anchor bearing plate nut 165*b* and the second anchor bearing plate nut 166*b* may therefore be adjusted relative to the threaded portions 152*a*, 152*b* in order to selectively define a position of the bearing plate 140 within the pocket 105.

The apparatus 110 may be further coupled by engaging the first clamp portion 130*a* with the first anchor component 150*a*. For example, the through portion 136*a* of the first clamp portion 130*a* may be advanced to receive the pocket end 154*a* of the first anchor component 150*a*. The first anchor clamp portion nut 165*a* may then be threaded onto the threaded portion 152*a* in order to secure the first clamp portion 130*a* in place. Similarly, the second clamp portion 130*b* may be engaged with the second anchor component 150*b*. For example, the through portion 136*b* of the second clamp portion 130*b* may be advanced to receive the pocket end 154*b* of the second anchor component 150*b*. The second anchor clamp portion nut 166*a* may then be threaded onto the threaded portion 152*b* in order to secure the second clamp portion 130*b* in place.

Figure 10:
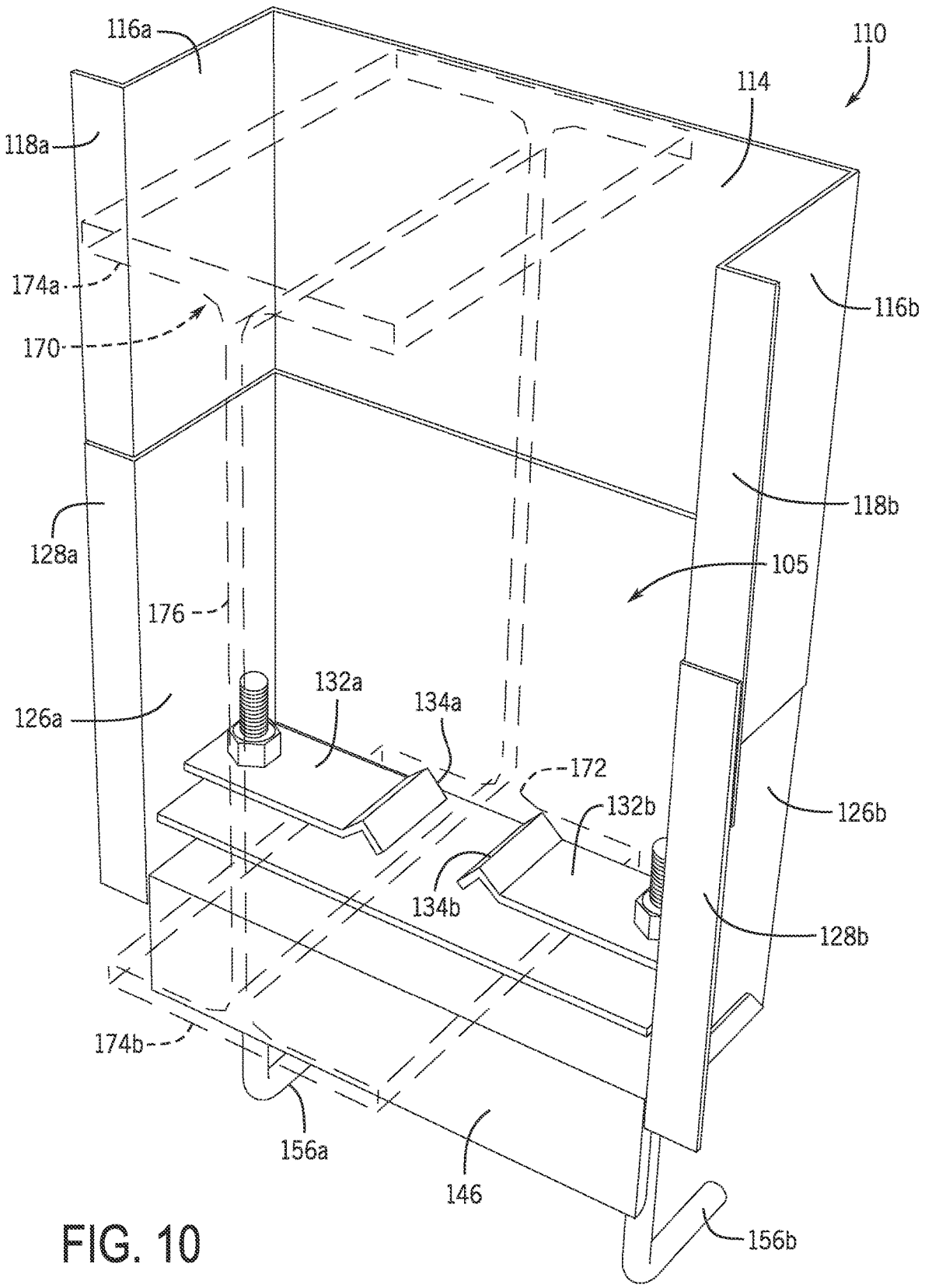
FIG. 10 depicts a front, top, right perspective view of the apparatus of FIG. 1 including a structural beam.
Figure 11:
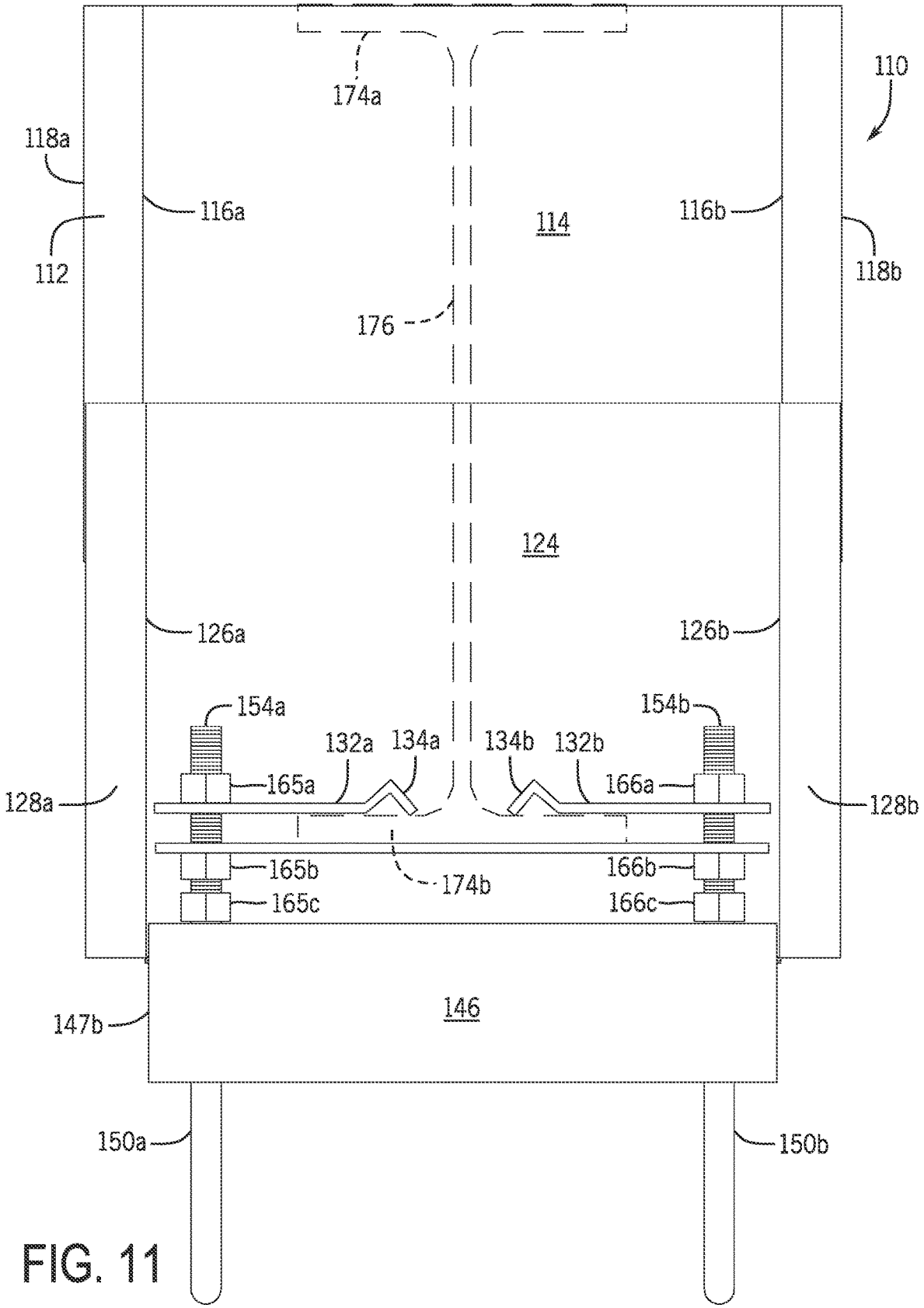
FIG. 11 depicts a front view of the apparatus of FIG. 10.
Figure 12:
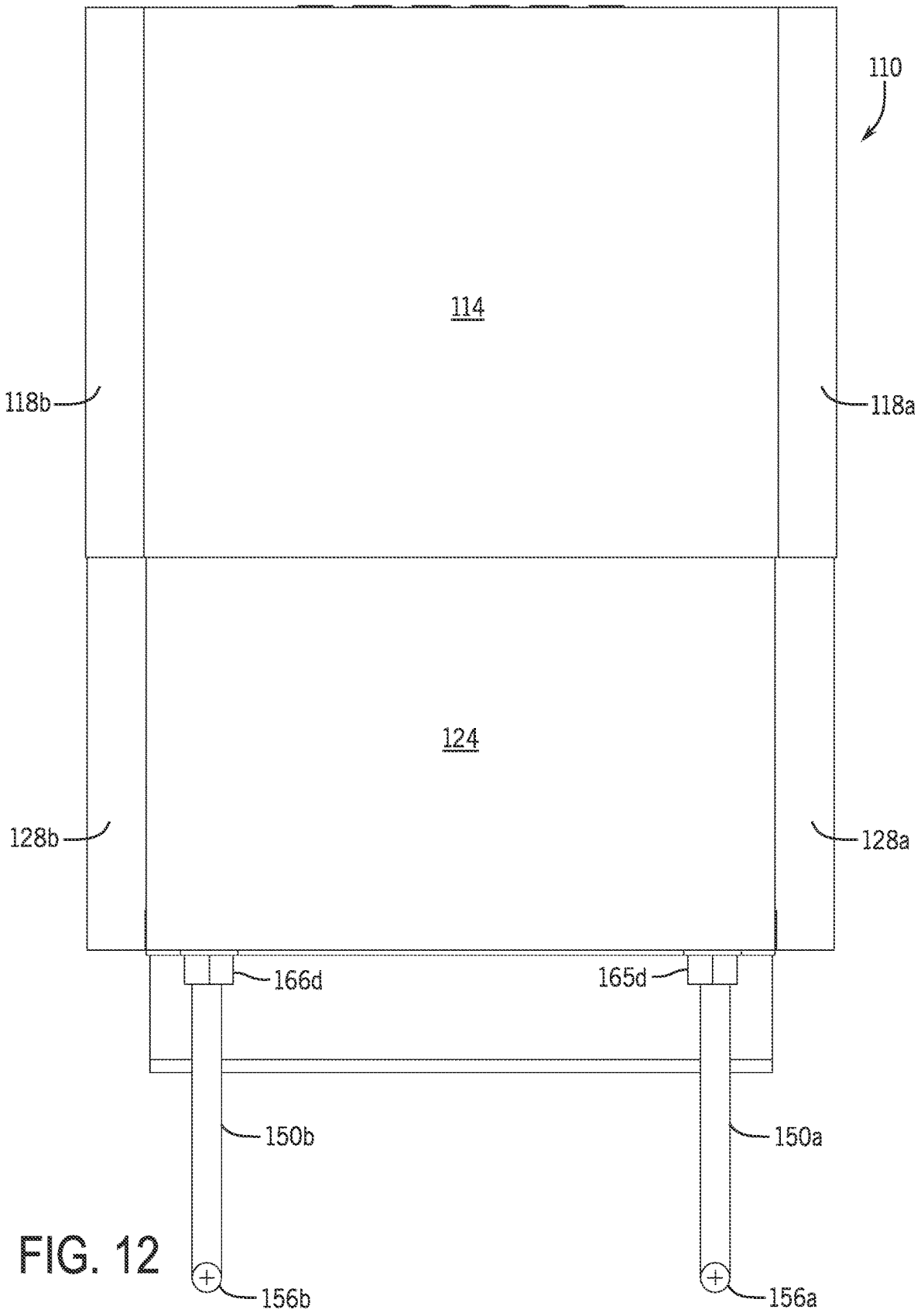
FIG. 12 depicts a rear view of the apparatus of FIG. 10.
Figure 13:
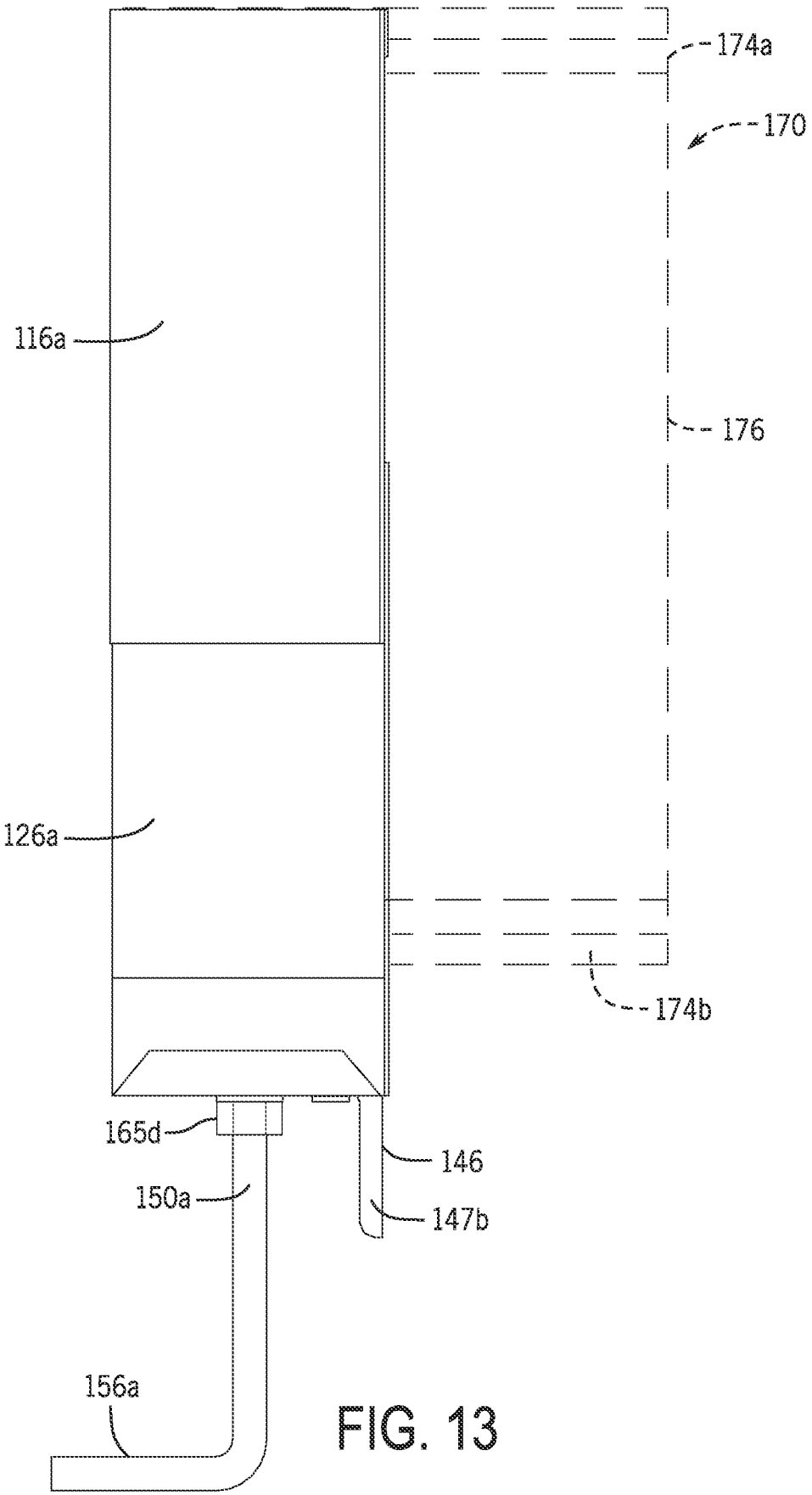
FIG. 13 depicts a left view of the apparatus of FIG. 10.
Figure 14:
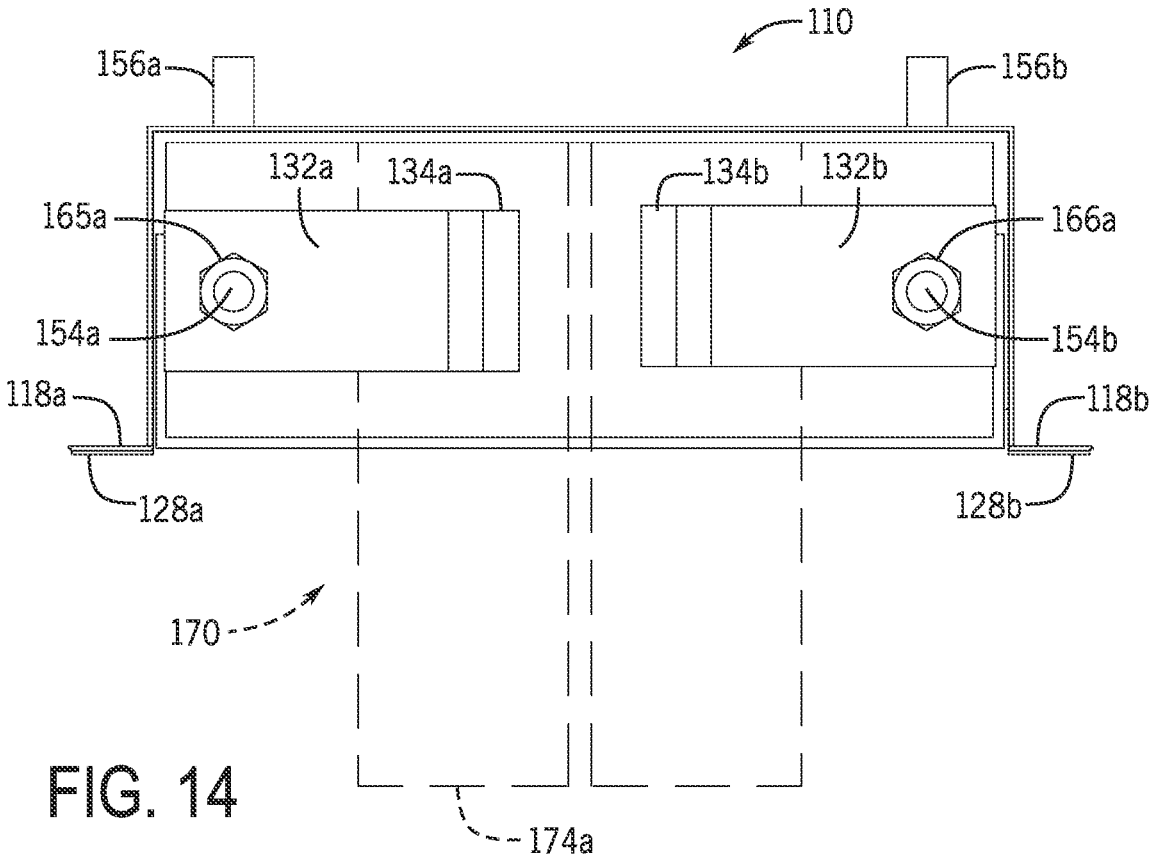
FIG. 14 depicts a top plan view of the apparatus of FIG. 10.
Figure 15:
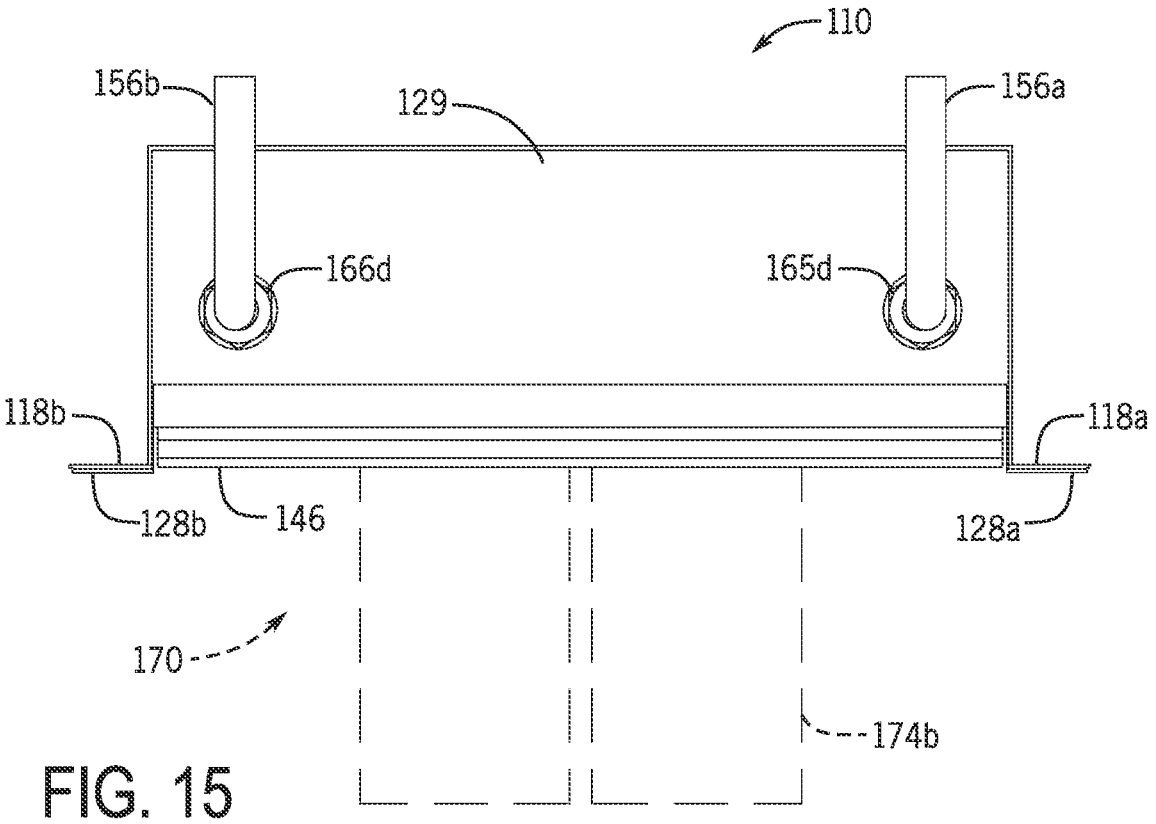
FIG. 15 depicts a bottom view of the apparatus of FIG. 10.
Figure 16:
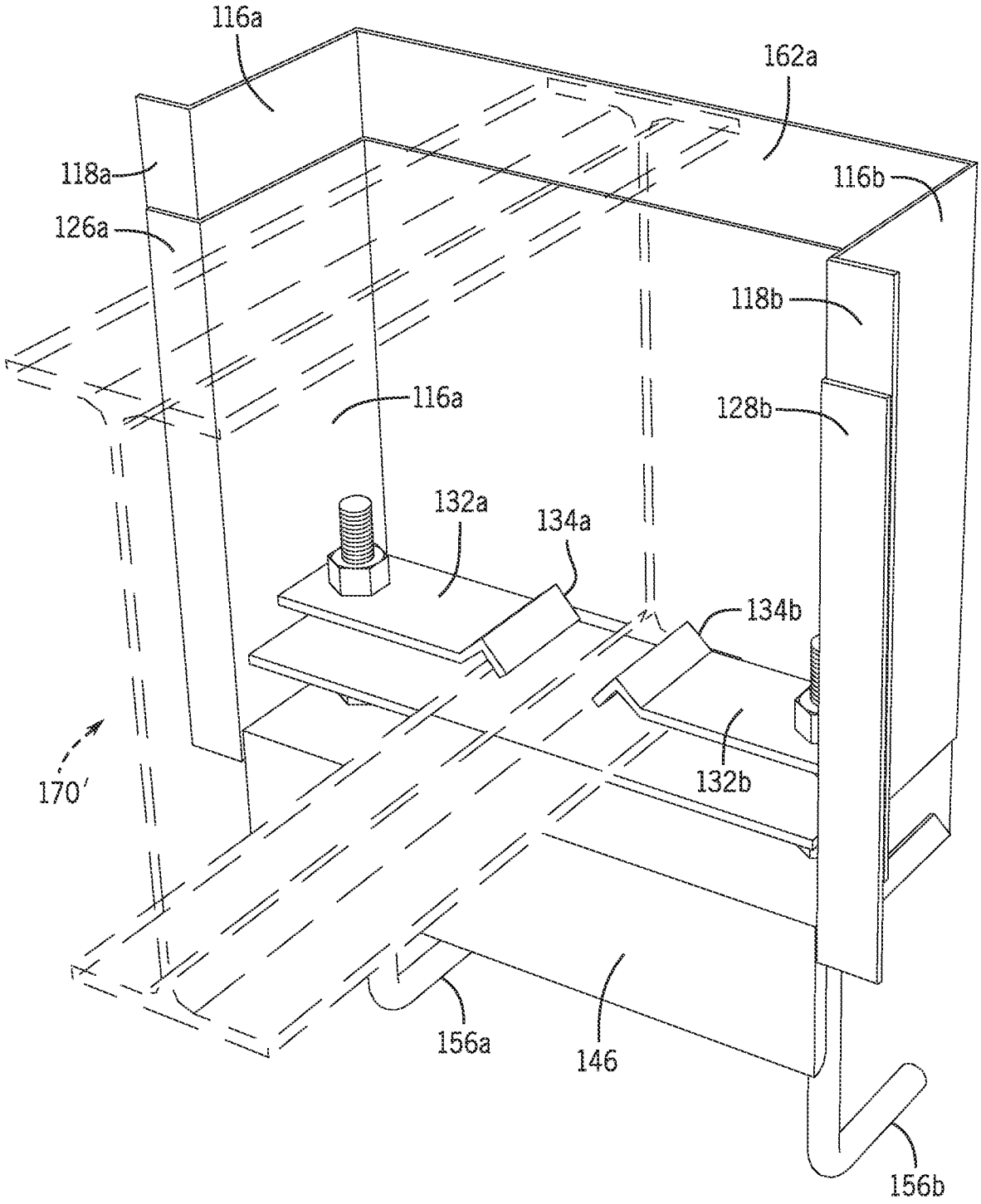
FIG. 16 depicts a front, top, right perspective view of the apparatus of FIG. 1, showing a small inserted beam.

For purposes of illustration, the apparatus 110 is shown in FIGS. 10-16 with the structural beam 170 received thereby, according to various views. FIG. 10 depicts a front, top, right perspective view of the apparatus of FIG. 1 including a structural beam. FIG. 11 depicts a front view of the apparatus and structural beam of FIG. 10. FIG. 12 depicts a rear view of the apparatus and structural beam of FIG. 10. FIG. 13 depicts a left view of the apparatus and structural beam of FIG. 10. FIG. 14 depicts a top plan view of the apparatus and structural beam of FIG. 10. FIG. 15 depicts a bottom view of the apparatus and structural beam of FIG. 10. FIG. 16 depicts a front, top, right perspective view of the apparatus and structural beam of FIG. 1, shown with a small inserted beam.

Figure 18:
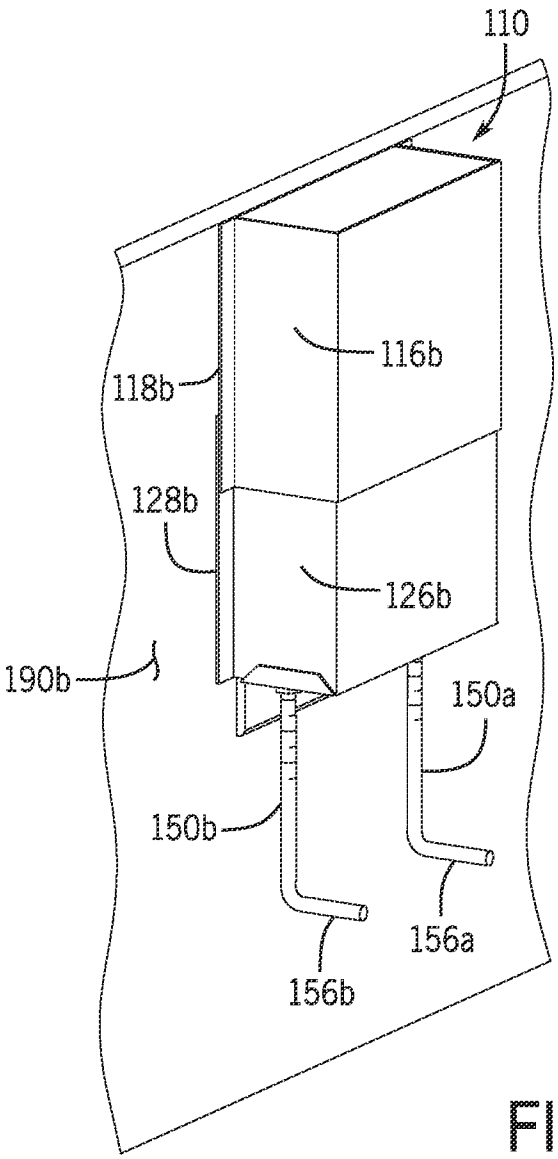
FIG. 18 depicts another view of the apparatus of FIG. 1 connected to the temporary form wall of FIG. 17.
Figure 17:
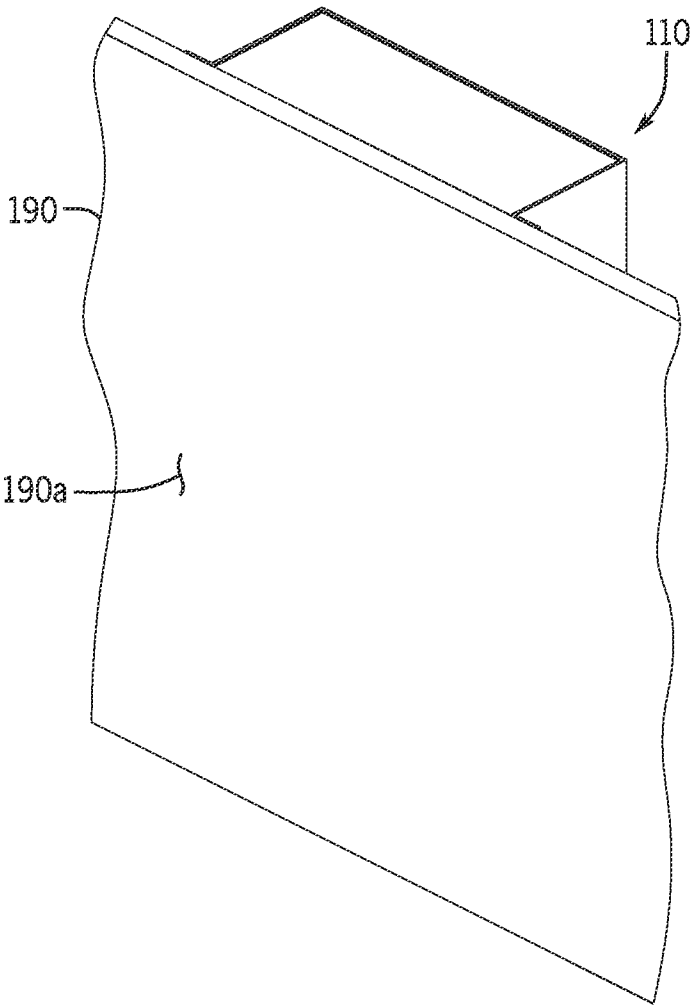
FIG. 17 depicts the apparatus of FIG. 1 connected to a temporary form wall without concrete.

In operation, the apparatus 110 may be coupled with a vertical structural members, of various types, and subsequently manipulated in order to receive and secure and end of a structural beam relative to the vertical structural member. In the case of a concrete wall, for example, the apparatus 110 may be arranged in a manner for permanent attachment to the wall. By way of illustration, FIGS. 17 and 18 show the apparatus 110 connected to a first form wall 190 of a concrete formworks. As used herein, "formworks" may refer to substantially any frame, form or the like used to receive and set concrete. In some cases, the formworks may be removable, such as may be the case with conventional concrete walls, whereas in other cases the formworks may form part of a permanent wall, such as may be the case with ICF-type walls. The first form wall 190 may include an outer surface 190*a* and an inner surface 190*b*. The first form wall 190 may be arranged such that that the outer surface 190*a* faces an interior of a building or structure and the inner surface 190*b* face an opposing direction for engagement and setting of the concrete.

Prior to connecting to the formworks, the apparatus 110 may be modified to accommodate a particular size of a structural beam. For example, the first frame portion 112 and the second frame portion 120 may be moved relative to one another in order to define a size of the pocket 105, as described above in relation to FIG. 2. For a taller structural beam 170, as shown in FIG. 10, the first and second frame portions 112, 120 may be moved away from one another such that the first and second frame portions 112, 120 define a slight overlap and form a larger pocket 105 for accommodating the structural beam 170. In other cases, such as for accommodating a smaller structural beam 170', as shown in FIG. 16, the first and second frame portions 112, 120 may be moved toward one another such that the first and second frame portions 112, 120 define a more substantial overlap and form a smaller pocket 105 for accommodating the structural beam 170'.

As illustrated in FIG. 18, the apparatus 110 may be connected to the first form wall 190 at the inner surface 190*b*. The apparatus 110 may be connected to the first form wall 190 with the pocket 105 facing the first form wall 190. Fasteners of various types may be used to secure the lips 118*a*, 118*b* and/or the lips 128*a*, 128*b* to the first form wall 190 at the inner surface 190*b*. With the apparatus 110 connected to the first form wall 190, the first anchor component 150*a* may run generally parallel to the first form wall 190, with the wall end 156*a* curved and extending generally perpendicular from the first form wall 190. Similarly, the second anchor component 150*b* may run generally parallel to the first form wall 190, with the wall end 156*b* curved and extending generally perpendicular from the first form wall 190. In this regard, the first and second anchor components 150*a*, 150*b* will run in multiple direction with the wall (as defined by the formworks) to support the permanent coupling of the apparatus 110 to the wall.

Figure 19:
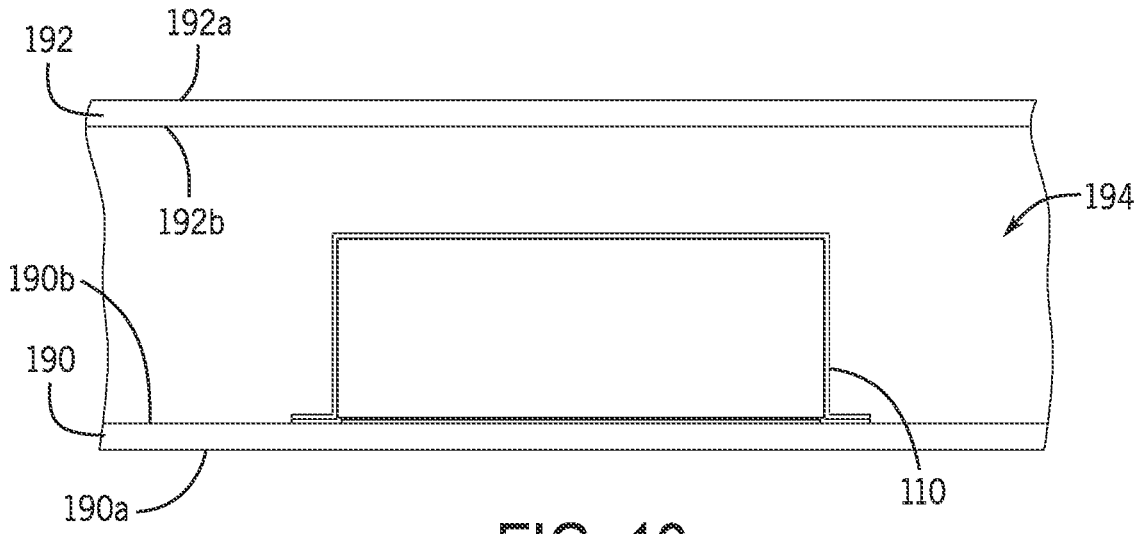
FIG. 19 depicts the apparatus of FIG. 1 set in formworks including the form wall of FIG. 17 and another form wall.

For example, and with reference to FIG. 19, a top view of the formworks is shown including a second form wall 192. The second form wall 192 include an outer surface 192*a* and an inner surface 192*b*. The outer surface 192*a* may be a surface that faces an exterior of a building or otherwise faces away from a structural beam that is to be received by the apparatus 110. The inner surface 192*b* faces the inner surface 190*b* of the first form wall 190. The inner surfaces

Figure 20:
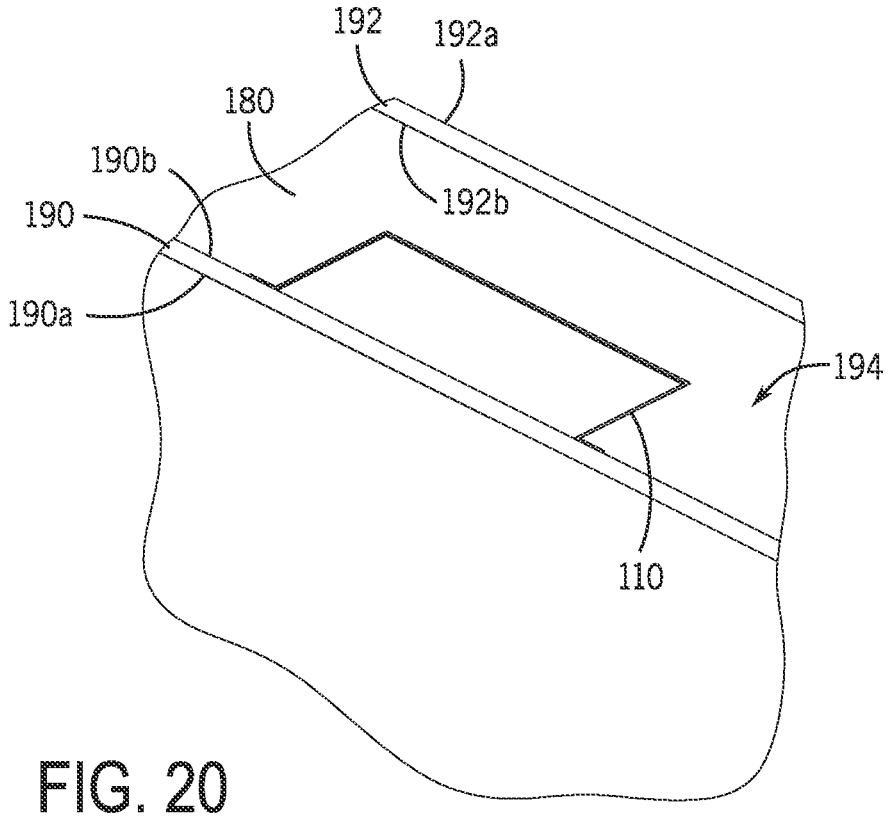
FIG. 20 depicts the apparatus of FIG. 1 set in concrete held by the formworks of FIG. 19.

190*b*, 190*b* cooperate to define a space 194 between the first and second form walls 190*a*, 190*b*. The space 194 may be prepared with rebar and like as required for reinforcement. The space 194 may subsequently receive concrete therein, which is held and formed to define a shape of the vertical structural member 180, as shown in FIG. 20. Pouring concrete into the space 194 may cause the concrete to engage and set with the first and second anchor components 150*a*, 150*b*.

Figure 21:
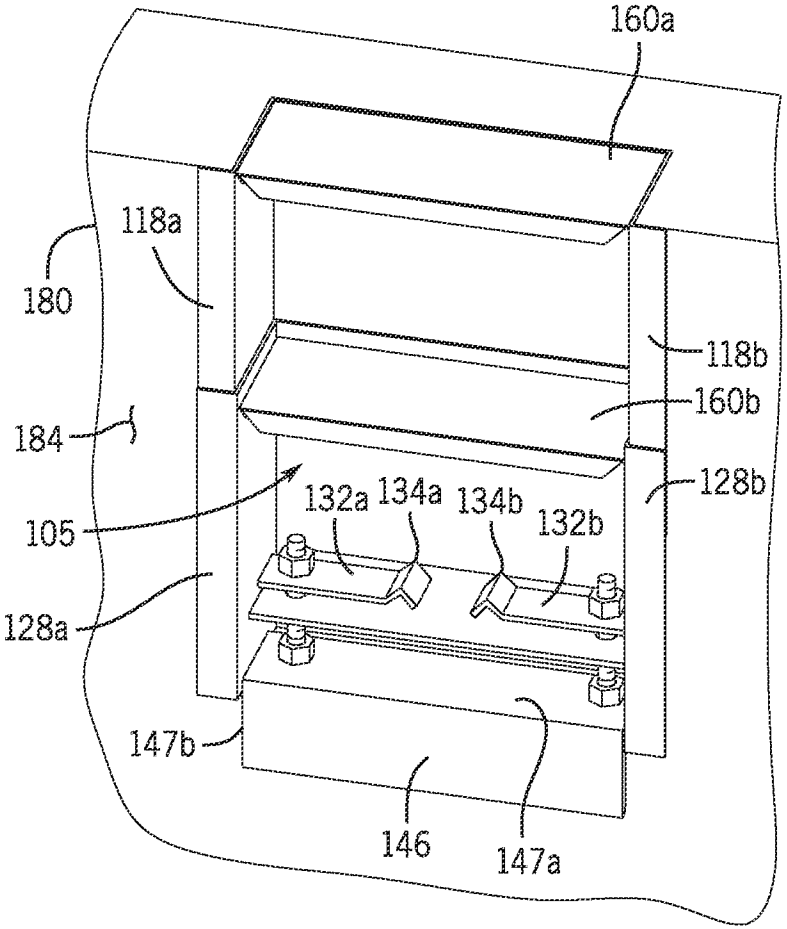
FIG. 21 depicts the apparatus of FIG. 21 set in a wall formed by the concrete of FIG. 20 with the temporary formworks removed.

The concrete of the vertical structural member 180 may be cured and the formworks removed, as shown in FIG. 21. With the formworks removed, the pocket 105 may be exposed along an outer surface 184 of the vertical structural member 180. The reinforcement shelves 160*a*, 160*b* are shown in FIG. 21 which may help the first and second frame portions 112, 120 maintain the shape of the pocket 105 during the pouring and setting of the concrete. FIG. 21 further shows the lips 118*a*, 118*b* and the lips 128*a*, 128*b* arranged covering corners of the vertical structural member 180. The apparatus 110 is permanently installed with the vertical structural member 180 and the lips 118*a*, 118*b* and the lips 128*a*, 128*b* operating, among other functions, to protect or shield the unaged edges of the concrete. Further, the structural angle 146 is shown in FIG. 21, with the second portion 147*b* aligned with or parallel or substantially flush with an outer surface 184 of the vertical structural member 180. The first portion 147*a* of the structural angle 146 is set in the wall and defining a bottommost side of the pocket 105 such that, upon receipt of a beam, the structural angle functions more evenly distribute a point load from the beam to the vertical structural member 180.

Next, the structural beam 170 may be received by the apparatus 110. To accommodate the structural beam 170, the reinforcement shelves 160*a*, 160*b* may be removed from the respective first and second frame portions 112, 120. For example, set screws or other fasteners may be removed from the reinforcement shelves 160*a*, 160*b* such that that the reinforcement shelves 160*a*, 160*b* can be separated from the first and second frame portions 112, 120 and recycled or discarded. In order to further prepare for receiving the structural beam 170, the first and second clamp portions 130*a*, 130*b* may also be temporarily removed by the unthreading of the first and second anchor clamp portion nuts 165*a*, 166*a*.

Figure 22:
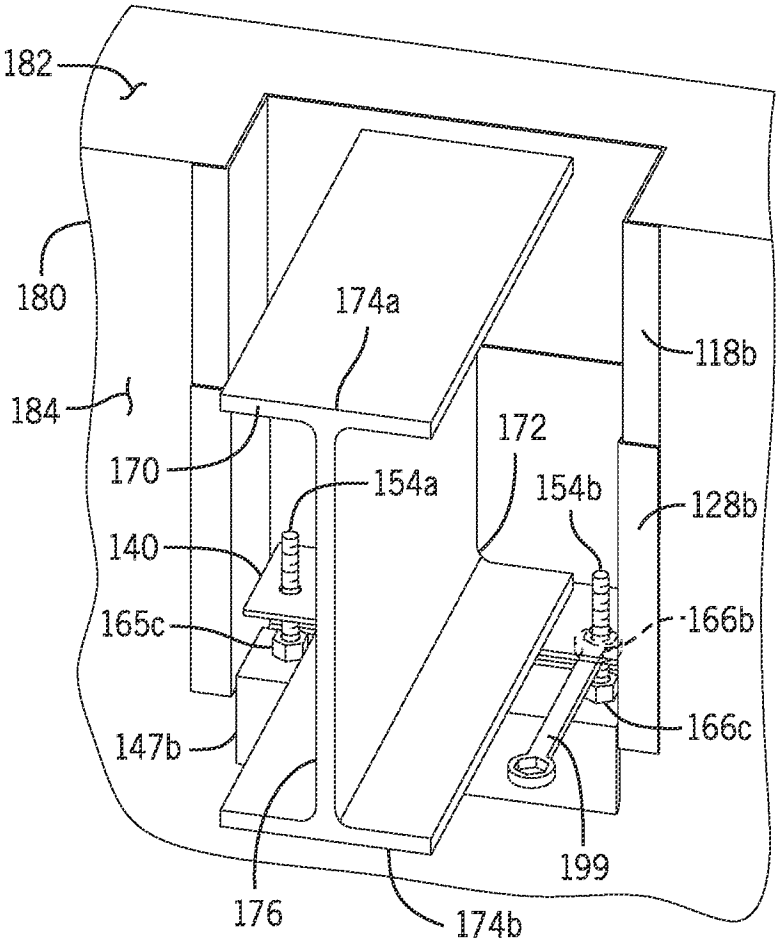
FIG. 22 depicts the apparatus of wall of FIG. 21 with a beam set in the apparatus for adjustment with a tool.

With the foregoing components removed, the structural beam 170 can be received by the apparatus 110. For example, and as shown in FIG. 22, the end 172 of the structural beam 170 may be received in the pocket 105. The bottom flange 174*b* of the structural beam 170 may rest on the bearing plate 140. A crane may be used to initially hoist the structural beam 170 for receipt in the pocket 105. Upon resting of the bottom flange 174*b* on the bearing plate 140, the crane may generally cease supporting the structural beam 170. That is, the remainder of the installation and construction process of the structural beam 170 may be accomplished without a crane, thereby substantially reducing crane time and associated costs. With further reference to FIG. 22, bearing plate 140 may be adjusted in order to selectively define a position of the end 172 of the structural beam 170 in the pocket 105. By way of illustration, a tool 199, may be used to threadably advance the first anchor bearing plate nut 165*b* and the second anchor bearing plate nut 166*b* relative to the respective threaded portions 152*a*, 152*b*. In so doing, the position or height of the bearing plate 140 in the pocket 105 may move correspondingly. In turn, the position of the end 172 of the structural beam 170 may also be manipulated. The tool 199 may be a manually operated tool 199, such as a wrench, thereby allowing the position of the structural beam 170 to be adjusted without the use of the crane.

Figure 24:
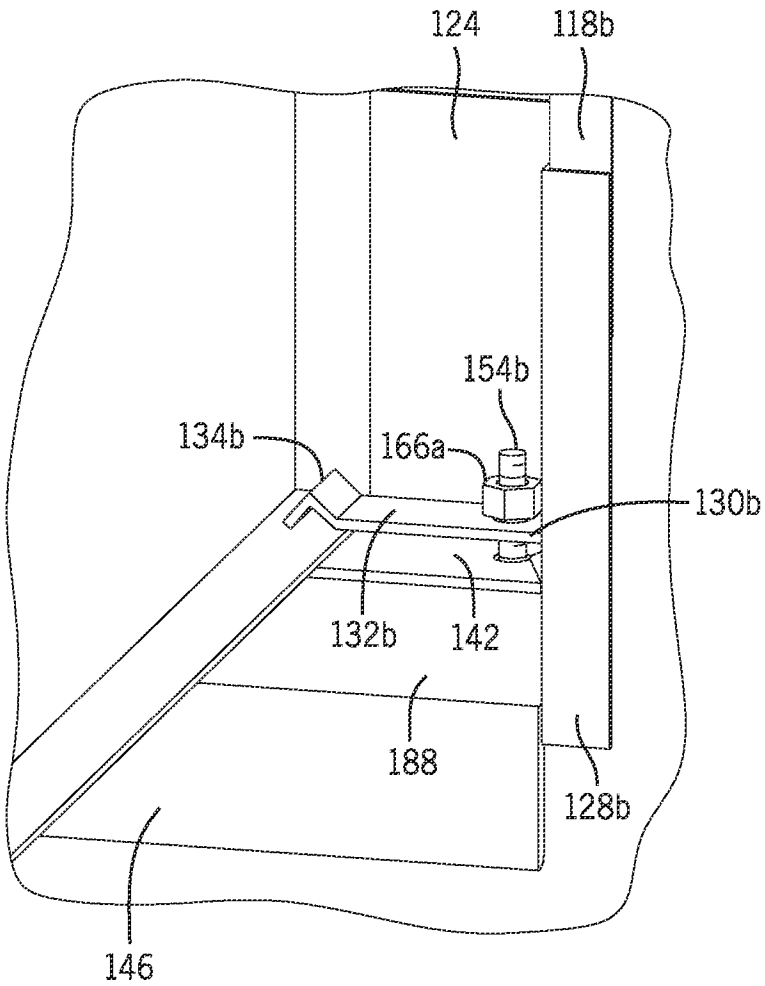
FIG. 24 depicts a grouting added to the apparatus.
Figure 23:
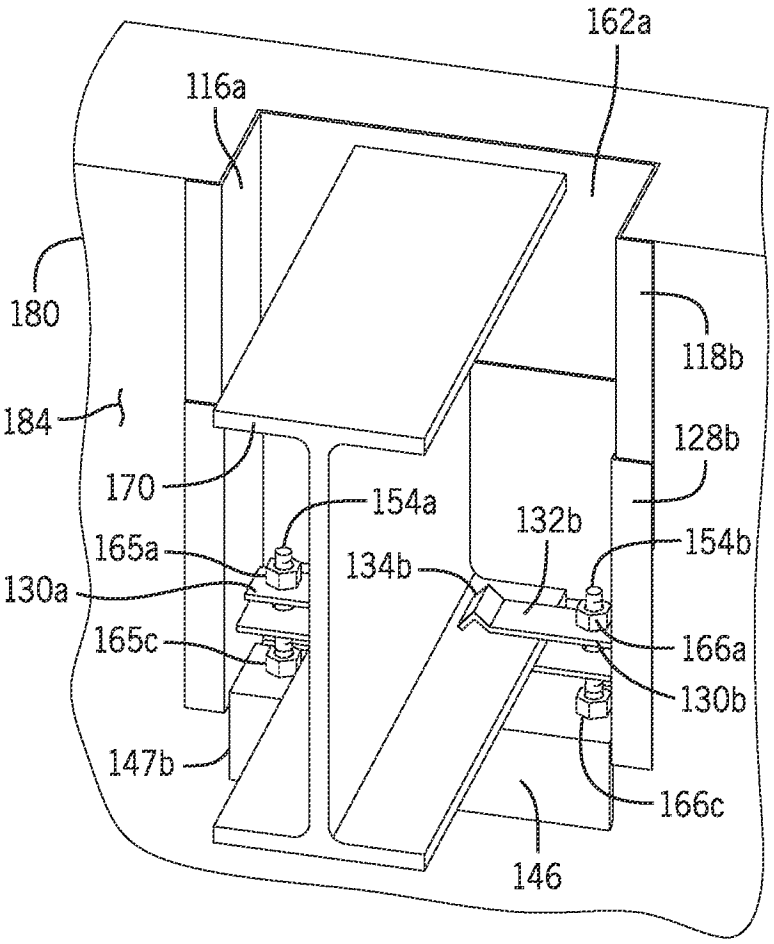
FIG. 23 depicts the beam of FIG. 22 clamped in the apparatus and connected to the wall before grouting.

With the structural beam 170 arranged at a desired position in the pocket 105, the clamp may operate to secure the end 172 of the structural beam 170 in the pocket 105. For example, and as illustrated in FIG. 23, the first and second clamp portions 130*a*, 130*b* may be advanced onto the respective pocket ends 154*a*, 154*b*. The first clamp portion 130*a* may be arranged on a first side of the web 176 with the engagement end 134*a* contacting the bottom flange 174*b*. The second clamp portion 130*b* may be arranged on a second side of the web 176 with the engagement end 134*b* contacting the bottom flange 174. The first and second anchor clamp portion nuts 165*a*, 166*a* may then be threaded onto the respective threaded portions 152*a*, 152*b* in order to secure the clamp portions 130*a*, 130*b* in place. The first and second anchor clamp portion nuts 165*a*, 166*a* may be adjusted as needed such that the bottom flange 174 is compressed between the bearing plate 140 and the first and second clamp portions 130*a*, 130*b*. Optional grouting 188 may then be added, as shown in FIG. 24, between the bearing plate 140 and the structural anchor 146.

Figure 25:
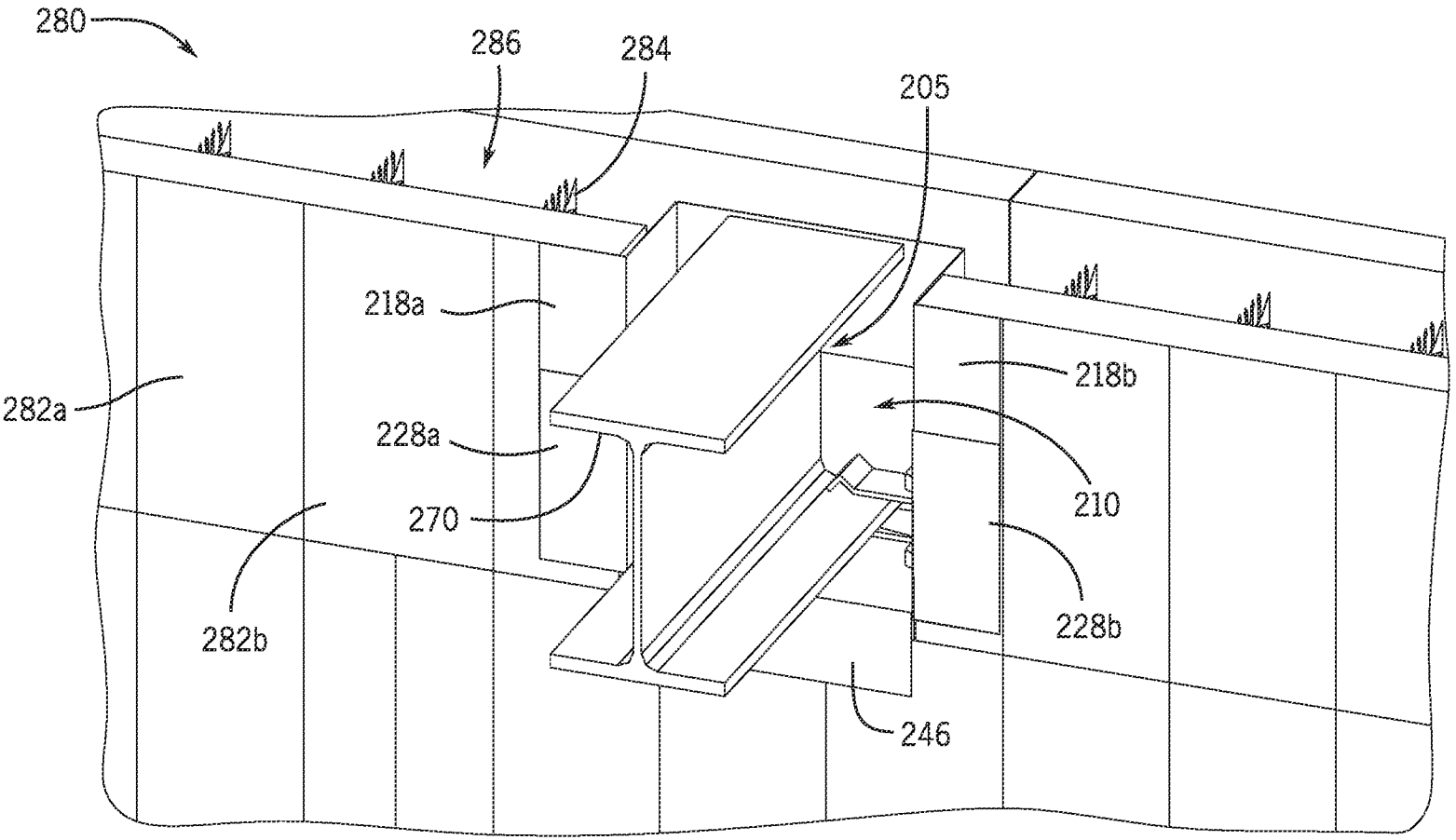
FIG. 25 depicts another example apparatus for connecting a beam to an insulated concrete form wall without concrete.

With reference to FIGS. 17-24 the apparatus 110 is shown and described above with respect to integration and connection with a concrete wall. It will be appreciate that the foregoing is one example implementation of the apparatus 110 and apparatuses described herein, shown for purposes of illustration. In other cases, the apparatus 110, and variations thereof, may be implemented with different types of vertical structural members. For example, and with reference to FIG. 25, an apparatus 210 is shown connected to a vertical structural member 280. The vertical structural member 280 may be an ICF-type wall. The ICF-type wall may include a modular system of formwork that remains in place post concrete pour. In the example of FIG. 25, the vertical structural member 280 includes a first block 282*a*, a second block 282*b* and a plurality of other blocks that cooperate to modularly form the ICF-type wall. The first and second blocks 282*a*, 282*b* may be rigid thermal insulating layers. The first and second blocks 282*a*, 282*b*, along with the plurality of remaining blocks may be permeant features that form the interior and exterior walls of a structure. The first and second blocks 282*a*, 282*b* may include or be associated with reinforcement 284, such as various type of structural reinforcement with a space 286. The space 286 may be filled with concrete to form the vertical structural member 280 from the blocks and concrete.

The apparatus 210 may be substantially analogous to the apparatus 110 and include, among other components, a frame defining a pocket 205, a clamp within the pocket configured to secure an end 272 of a structural beam 270. The clamp of the apparatus 220 may be configured to selectively define the position of the structural beam 270 relative to the frame. The apparatus 210 may further include one or more anchor components extending away from the frame for mounting with the vertical structural member.

In one example, the apparatus 210 may be connected to the blocks of the vertical structural member 280 prior to pouring of concrete in the space 286. For examples, lips 218*a*, 218*b* and/or lips 228*a*, 228*b* of the frame may be coupled to an one or more adjacent blocks of the modular construction of blocks in order to arrange the apparatus 220 in the wall with the anchor components extending into the space 286. Concrete may be poured into the space 286 and engage the at one anchor components of the apparatus 210 that are positioned in the space 286 such that the apparatus 210 become permanently attached to the wall. In turn, the structural beam 270 may be connected to the apparatus 220 in a manner substantially analogous to that as described above with respect to FIGS. 17-24.

Turning to FIGS. 26A-27B, examples of the present disclosure are shown for structural beams that include wood beams. Broadly, the apparatus of the present disclosure may be configured to couple wood beams to vertical structural members in a manner substantially analogous to that as described above with reference to steel beams. The apparatus of the present disclosure may be configured to couple the wood beam to both concrete vertical structural members or walls and/or ICF-type walls, based on a given configuration. As described in greater detail below, the apparatus may include one or more components that are tailored for use in coupling a wood beam to a vertical structural member, such as T-shaped bearing plates, as one example.

Figure 26A:
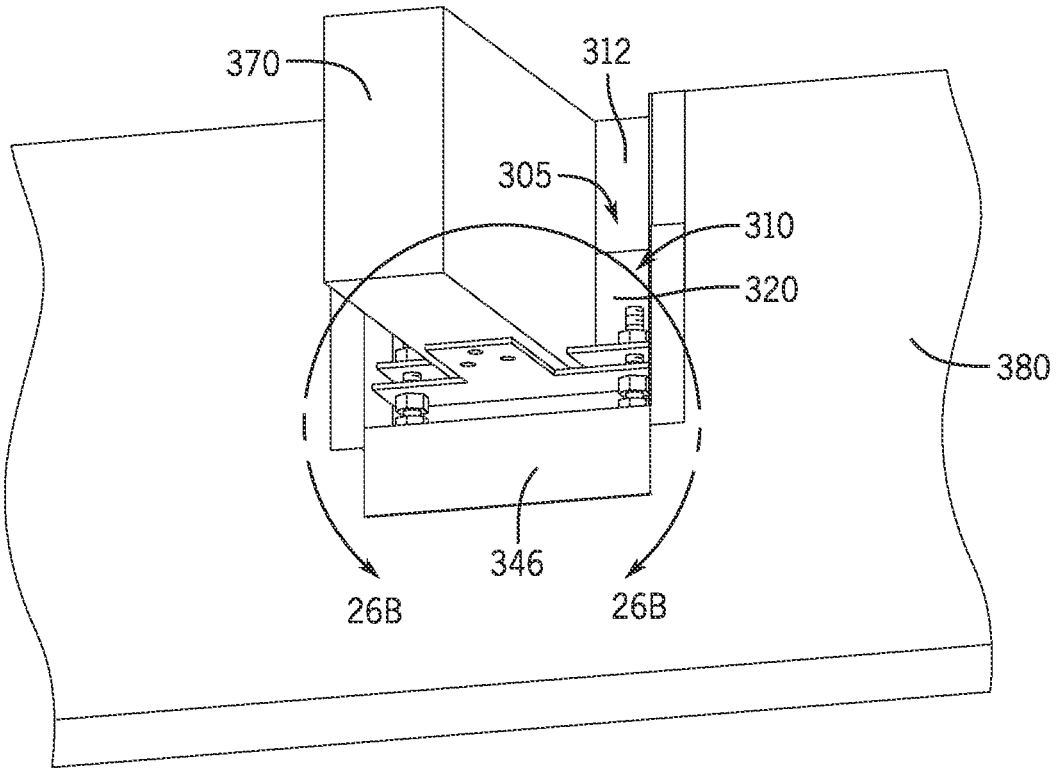
FIG. 26A depicts another example apparatus for connecting a beam to a wall, including a wood beam and wood beam connection plate, with concrete shown.
Figure 26B:
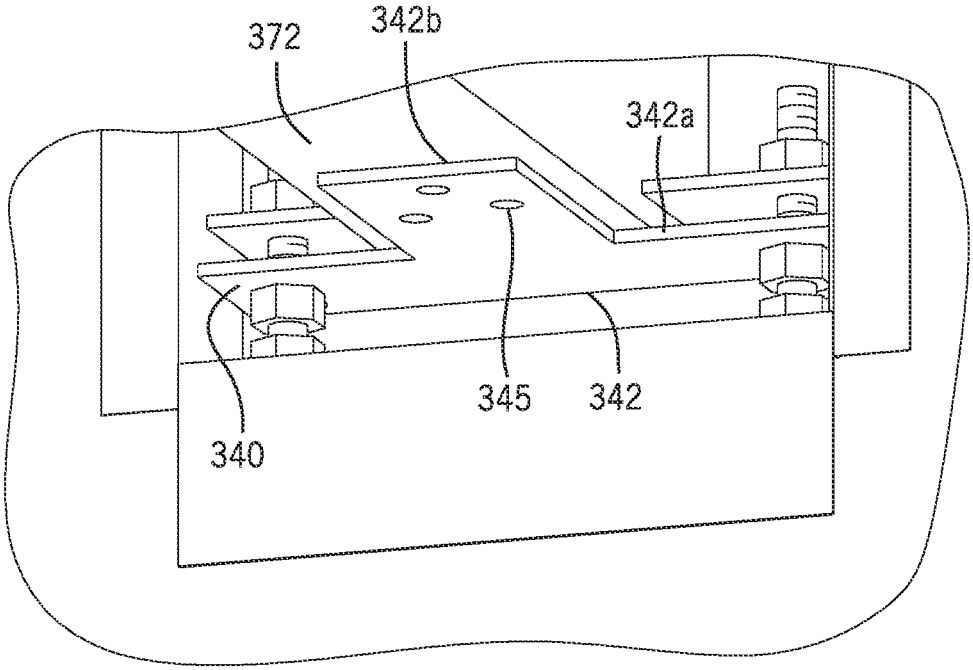
FIG. 26B depicts detail 26B-26B of FIG. 26A.

With reference to FIGS. 26A and 26B, an apparatus 310 is shown connected to a vertical structural member 380. The vertical structural member 380 may be a concrete wall, such as any of the concrete walls described herein. The apparatus 310 may be substantially analogous to the apparatus 110 and/or the apparatus 210 described herein. For example, and without limitation, the apparatus 310 may include a frame with frame portions 312 and 320 defining a pocket 305, and a clamp within the pocket 305 configured to secure an end of a beam 370, such as a wood beam. The clamp of the apparatus 310 may be configured to selectively define the position of the beam 370 relative to the frame. The apparatus 310 may further include one or more anchor components extending away from the frame for mounting with the vertical structural member.

Notwithstanding the foregoing similarities, the apparatus 310 may include a bearing plate 340, as shown in FIG. 26B. The bearing plate 340 may be configured for supporting wood beams, such as the beam 370. For example, the bearing plate 340 may be a generally T-shaped structure having a plate body 342. The plate body 342 may include a pocket portion 342*a* and a beam portion 342*b*. The pocket portion 342*a* may be generally arranged in the pocket 305 and engaged with one or more anchor components of the apparatus 310. The beam portion 342*b* may extend from the pocket portion 342*a* generally running along a length of the beam 370. For example, the beam portion 342*b* may extend along a length of the beam 370 for engagement and support of an underside 372 of the beam 370. Openings 345 may be provided through the beam portion 342*b*. The T-shaped structure of the bearing plate 342 may provide additional structural support to the wood beam.

Figure 27A:
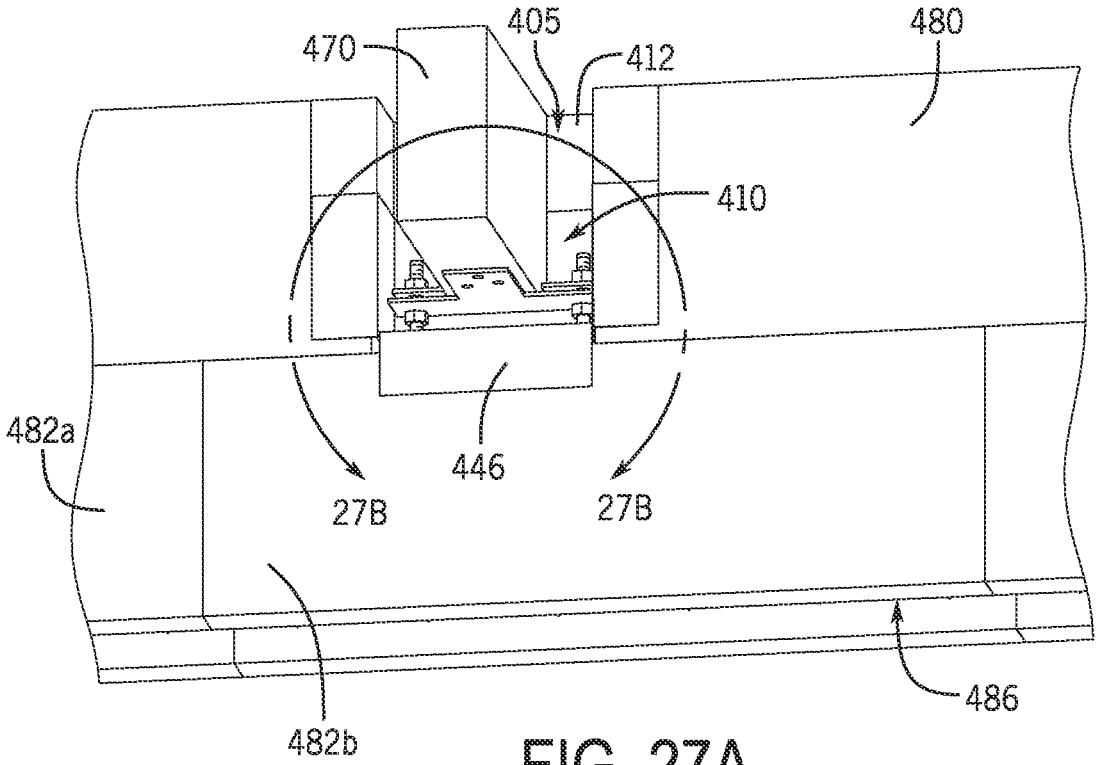
FIG. 27A depicts another example apparatus for connecting a beam to a wall, including a wood beam and wood beam connection plate, with an insulated concrete form wall, shown without concrete.
Figure 27B:
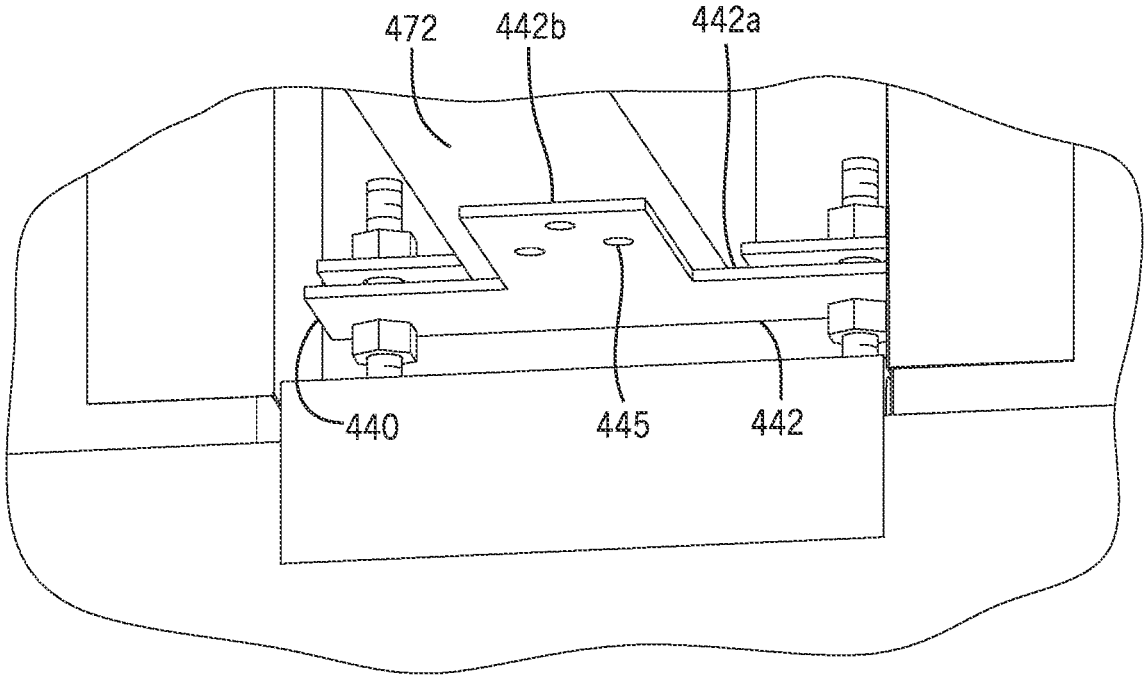
FIG. 27B depicts detail 27B-27B of FIG. 27A.

With reference to FIGS. 27A and 27B, an apparatus 410 is shown connected to a vertical structural member 480. The vertical structural member 480 may be an ICF-type wall, such as any of the ICF-type walls described herein. In this regard, the vertical structural member 480 may include a space 486 (for concrete) and panels 428*a*, 428*b*. The apparatus 410 may be substantially analogous to the apparatus 110, the apparatus 210, and/or the apparatus 310, described herein. For example, and without limitation, the apparatus 410 may include a frame with frame portions 412 and 420 defining a pocket 405, and a clamp within the pocket 405 configured to secure an end of a beam 470, such as a wood beam. The clamp of the apparatus 410 may be configured to selectively define the position of the beam 470 relative to the frame. The apparatus 410 may further include one or more anchor components extending away from the frame for mounting with the vertical structural member.

Notwithstanding the foregoing similarities, the apparatus 410 may include a bearing plate 440, as shown in FIG. 27B. The bearing plate 440 may be configured for supporting wood beams, such as the beam 470. For example, the bearing plate 440 may be a generally T-shaped structure having a plate body 442. The plate body 442 may include a pocket portion 442*a* and a beam portion 442*b*. The pocket portion 442*a* may be generally arranged in the pocket 405 and engaged with one or more anchor components of the apparatus 410. The beam portion 442*b* may extend from the pocket portion 442*a* generally running along a length of the beam 470. For example, the beam portion 442*b* may extend along a length of the beam 470 for engagement and support of an underside 472 of the beam 470. Openings 445 may be provided through the beam portion 442*b*. The T-shaped structure of the bearing plate 442 may provide additional structural support to the wood beam.

Figure 28:
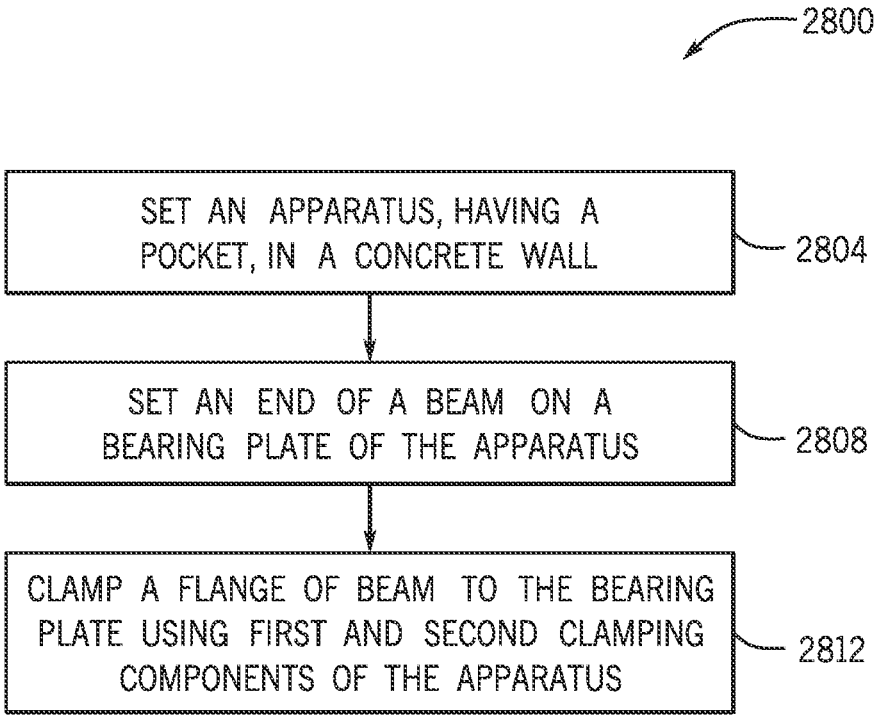
FIG. 28 depicts a flow diagram including a method for connecting a beam to a wall.

To facilitate the reader's understanding of the various functionalities of the examples discussed herein, reference is now made to the flow diagram in FIG. 28, which illustrates process 2800. While specific steps (and orders of steps) of the methods presented herein have been illustrated and will be discussed, other methods (including more, fewer, or different steps than those illustrated) consistent with the teachings presented herein are also envisioned and encompassed with the present disclosure.

At operation 2804, an apparatus having a pocket is set in a concrete wall. For example, and with reference to FIGS. 17-21, the apparatus 110 is set in a vertical structural member 180. The apparatus 110 may be connected to formworks for the concrete wall, such as being temporarily screwed to the first form wall 190. Concrete may be poured into the space 194 defined by the formworks. The concrete may engage and set with the first and second anchor components 150*a*, 150*b* that are arranged in the space 194, thereby connecting the apparatus 110 to the vertical structural member. In other cases, and as shown in FIG. 25, the apparatus 210 may be connected to an ICF-type wall, in which the apparatus 220 is fixed to module blocks to define formwork for the concrete and that define the final exterior and interior surfaces of the wall.

At operation 2808, an end of a beam is set on a bearing plate of the apparatus. For example, and with reference to FIG. 22, the structural beam 170 is set on the bearing plate 140. The bearing plate 140 may be capable of supporting a load of the structural beam 170. In this regard, once set on the bearing plate 140, the structural beam 170 may be released from a crane. The height of the bearing plate 140 may be adjusted in the pocket 105 in order to selectively define a position of the end 172 of the structural beam 170 therein. For example, the first anchor bearing plate nut 165*b* and the second anchor bearing plate nut 166*b* may be adjusted in order to define a height of the bearing plate 140 and correspondingly define a position of the end 172 of the beam 170 in the pocket 105.

At operation 2812, a flange of the beam is clamped to the bearing plate using first and second clamping components of the apparatus. For example, and with reference to FIG. 23, the lower flange 174*b* of the structural beam 170 may be clamped using the first and second clamping components 130*a*, 130*b*. For example, the first clamping component 130*a* may be advanced onto the first anchor component 150*a* and the second clamping component 130*b* may be advanced onto the second anchor component 150*b*. The first and second anchor clamp portion nuts 165*a*, 166*a* may then be threaded onto the respective threaded portions 152*a*, 152*b* in order to secure the clamp portions 130*a*, 130*b* in place.

Other examples and implementations are within the scope and spirit of the disclosure and appended claims. For example, features implementing functions may also be physically located at various positions, including being distributed such that portions of functions are implemented at different physical locations. Also, as used herein, including in the claims, "or" as used in a list of items prefaced by "at least one of" indicates a disjunctive list such that, for example, a list of "at least one of A, B, or C" means A or B or C or AB or AC or BC or ABC (i.e., A and B and C). Further, the term "exemplary" does not mean that the described example is preferred or better than other examples.

The foregoing description, for purposes of explanation, uses specific nomenclature to provide a thorough understanding of the described examples. However, it will be apparent to one skilled in the art that the specific details are not required in order to practice the described examples. Thus, the foregoing descriptions of the specific examples described herein are presented for purposes of illustration and description. They are not targeted to be exhaustive or to limit the examples to the precise forms disclosed. It will be apparent to one of ordinary skill in the art that many modifications and variations are possible in view of the above teachings.

What is claimed is:

1. An apparatus for connecting a beam to a wall, the apparatus comprising:

a frame comprising a first frame portion received within a second frame portion, each of the first frame portion and the second frame portion having a plurality of panels that cooperate to define a pocket to receive an end of the beam, the first frame portion and the second frame portion configured to adjust a dimension of the pocket;

a clamp within the pocket and configured to secure an end of the beam at a position within the pocket, wherein the clamp is configured to selectively define the position relative to the frame; and at least one anchor extending from the clamp and away from the pocket for mounting with the wall.

2. The apparatus of claim 1, further comprising wherein the plurality of panels of the first frame portion comprises a structural angle resting at least partially on the third panel between the first panel and the second panel; and wherein the structural angle, the first panel, and the second panel cooperate to define different sides of the pocket.

3. The apparatus of claim 2, wherein the structural angle comprises a steel angle having a first portion defining a side of the pocket and a second portion configured for flush mounting with the wall.

4. The apparatus of claim 3, wherein the first and second portions of the structural angle are perpendicular to one another.

5. The apparatus of claim 3, wherein the at least one anchor:

extends from the clamp and through the first portion of the structural angle, and comprises an end arranged outside of the pocket for mounting with the wall.

6. The apparatus of claim 5, wherein the at least one anchor comprises a first anchor and a second anchor, each of the first and second anchors extending from the clamp and through the first portion of the structural angle for mounting of ends of the respective first and second anchors in the wall.

7. The apparatus of claim 1, wherein the clamp comprises a bearing plate configured to seat the end of the beam.

8. The apparatus of claim 7, wherein the bearing plate is configured to receive a grouting thereunder.

9. The apparatus of claim 7, wherein the clamp further comprises at least one clamping component configured to engage the end of the beam opposite the bearing plate.

10. The apparatus of claim 9, wherein the at least one clamping component and the bearing plate are engaged with the at least one anchor in the pocket, and a position of the at least one clamping component and the bearing plate are adjustable along the at least one anchor to clamp and secure the end of the beam in the apparatus.

11. The apparatus of claim 10, wherein the at least one anchor includes a threaded end advanced through each of the at least one clamping component and the bearing plate, and the apparatus further comprises a bottom nut threadingly engaged with the threaded end and manipulatable to define a stop position for the bearing plate in the pocket, and a top nut threadingly engaged with the threaded end and manipulatable to compress the at least one clamping component toward the bearing plate.

12. The apparatus of claim 9, wherein the at least one clamping component comprises a first clamping component and a second clamping component, and the first and second clamping components arranged relative to the bearing plate to receive a web of a beam therebetween.

13. The apparatus of claim 12, wherein the at least one anchor comprises a first anchor engaged with the bearing plate and the first clamping component, and a second anchor engaged with the bearing plate and the second clamping component, and the first and second clamping components are adjustable relative to the respective first and second anchors in order to compress a flange of the beam between the first and second clamping components and the bearing plate.

14. The apparatus of claim 1, wherein the plurality of panels comprises a first panel and a second panel, the first and second panels forming vertical sides of the pocket having a top and a bottom, the apparatus further comprises at least one reinforcement shelf spanning a vertical width of the pocket defined by the first and second panels, the at least one reinforcement shelf positioned between the top and bottom of the vertical sides of the pocket, and the at least one reinforcement shelf is configured to maintain the vertical width during an installation of the apparatus.

15. An apparatus for connecting a beam to a wall, the apparatus comprising:

a plurality of panels defining a pocket to receive an end of the beam, the plurality of panels comprising a first panel, a second panel, and a third panel extending between the first and second panels;

a structural angle positioned between the first panel and the second panel to rest at least partially on the third panel;

a first anchor positioned through the structural angle and extending away from the plurality of panels;

a second anchor positioned through the structural angle and extending away from the plurality of panel;

a bearing plate engaged with the first anchor and the second anchor and positioned between the first panel and the second panel;

a first clamping component engaged with the first anchor above the bearing plate; and a second clamping component engaged with the second anchor above the bearing plate.

16. A method of connecting a beam to a wall, the method comprising:

setting an apparatus in a concrete wall, the apparatus comprising a frame including a first frame portion received within a second frame portion to define a pocket therein, the first frame portion and second frame portion configured to adjust a dimension of the pocket;

setting an end of a beam on a bearing plate of the apparatus so that the bearing plate and the end of the beam are positioned at least partially within the pocket; and clamping a flange of the beam to the bearing plate using first and second clamping components arranged on opposing sides of a web of the beam.

17. The method of claim 16, wherein setting the apparatus in the concrete wall comprises:

attaching the frame of the apparatus to formwork, pouring concrete; and removing the formwork with the apparatus permanently affixed to the concrete.

18. The method of claim 16, further comprising setting a height of the bearing plate in the pocket.

19. The method of claim 18, wherein the bearing plate is engaged with a first anchor at a first bearing plate end and a second anchor at a second bearing plate end, and the height of the bearing plate is defined by a first nut threadingly engaged with the first anchor under the bearing plate and a second nut threadingly engaged with the second anchor under the bearing plate.

20. The method of claim 16, further comprising grouting a region below the bearing plate.

* * * * *